United States Patent [19]

Kinoshita et al.

[11] Patent Number: 4,946,153

[45] Date of Patent: Aug. 7, 1990

[54] PAPER HANDLING APPARATUS WITH A PAPER STAPLING FUNCTION

[75] Inventors: Keichi Kinoshita; Akiyoshi Johdai; Hiroki Yamashita, all of Osaka; Kazuhito Ozawa, Toyokawa; Toshio Matsui, Osaka, all of Japan

[73] Assignee: Minolta Camera Kabushiki Kaisha, Osaka, Japan

[21] Appl. No.: 216,517

[22] Filed: Jul. 8, 1988

[30] Foreign Application Priority Data

| | | | |
|---|---|---|---|
| Jul. 10, 1987 | [JP] | Japan | 62-172386 |
| Oct. 16, 1987 | [JP] | Japan | 62-261989 |
| Nov. 13, 1987 | [JP] | Japan | 62-287691 |

[51] Int. Cl.[5] ..... B42B 2/00

[52] U.S. Cl. ..... 270/53; 270/58

[58] Field of Search ..... 270/37, 53, 58; 355/317, 324; 271/3.1, 279, 302, 207, 220, 221

[56] References Cited

U.S. PATENT DOCUMENTS

| | | | |
|---|---|---|---|
| 3,386,729 | 6/1968 | Pine . | |
| 3,645,615 | 2/1972 | Spear . | |
| 3,697,063 | 11/1972 | Greenfield et al. . | |
| 3,709,595 | 1/1973 | Turner et al. | 355/14 |
| 3,944,207 | 3/1976 | Bains | 270/58 |
| 4,067,649 | 1/1978 | Hubbard et al. . | |
| 4,073,391 | 2/1978 | O'Brien et al. | 214/65 |
| 4,076,408 | 2/1978 | Reid et al. | 355/14 |
| 4,123,155 | 10/1978 | Hubert . | |
| 4,134,672 | 1/1979 | Burlew | 270/58 |
| 4,145,037 | 3/1979 | Mol | 270/58 |
| 4,190,246 | 2/1980 | Sasuga . | |
| 4,203,587 | 5/1980 | Kishi et al. . | |
| 4,218,128 | 8/1980 | Satomi et al. . | |
| 4,227,275 | 10/1980 | Soderberg | 11/1 R |
| 4,238,066 | 12/1980 | Brooke | 227/39 |
| 4,248,413 | 2/1981 | Fox | 270/53 |
| 4,248,522 | 2/1981 | Sterrett | 355/14 SH |
| 4,265,440 | 5/1981 | Shibazaki et al. . | |
| 4,272,180 | 6/1981 | Satomi et al. . | |
| 4,281,920 | 8/1981 | Cross . | |
| 4,295,733 | 10/1981 | Janssen et al. | |
| 4,313,670 | 2/1982 | Caldwell . | |
| 4,361,393 | 11/1982 | Noto | 355/3 SH |
| 4,365,886 | 12/1982 | Murakami et al. . | |

(List continued on next page.)

FOREIGN PATENT DOCUMENTS

| | | |
|---|---|---|
| 99250 | 1/1984 | European Pat. Off. . |
| 3218747 | 12/1982 | Fed. Rep. of Germany . |
| 2732673 | 9/1984 | Fed. Rep. of Germany . |
| 3701450 | 7/1987 | Fed. Rep. of Germany . |
| 55-15150 | 2/1980 | Japan . |
| 57-131667 | 5/1982 | Japan . |
| 59-177232 | 7/1982 | Japan . |
| 57-72537 | 8/1982 | Japan . |
| 57-203037 | 2/1983 | Japan . |
| 59-43765 | 3/1984 | Japan . |
| 61-145069 | 12/1984 | Japan . |
| 60-183461 | 9/1985 | Japan . |
| 60-248563 | 12/1985 | Japan . |
| 61-72569 | 4/1986 | Japan . |
| 26061 | 6/1986 | Japan . |
| 61-261096 | 11/1986 | Japan . |
| 2185465 | 7/1987 | United Kingdom . |

*Primary Examiner*—Edward K. Look
*Assistant Examiner*—Therese M. Newholm
*Attorney, Agent, or Firm*—Burns, Doane, Swecker & Mathis

[57] ABSTRACT

An apparatus for storing papers ejected from a copying machine or the like and stapling them after alignment, comprises a contacting member which contacts each paper being transported into a stapling tray to urge the paper for alignment in a specified portion, and a plurality of pressing members for pressing the transported papers at the upper portion thereof against the tray, each of the pressing members is individually adapted correspondingly to the sizes of papers. The contact between the contacting member and the papers is relieved when the stapled papers are discharged from the tray. The pressing members are actuated in conjunction with the paper transporting operation correspondingly to the size of papers. The contacting member is arranged at a location less distant from transport rollers for transporting papers into the tray than the length of paper in the direction of transporting paper on the tray.

8 Claims, 24 Drawing Sheets

U.S. PATENT DOCUMENTS 4,368,972 1/1983 Naramore .
4,371,155 2/1983 Astero et al. ..... 270/53
4,376,529 3/1983 George et al. .
4,385,827 5/1983 Naramore .
4,411,515 10/1983 Kukucka et al. ..... 355/14 SH
4,424,963 1/1984 Bartholet et al. ..... 270/53
4,473,425 9/1984 Baughman et al. .
4,497,478 2/1985 Reschenhofer et al. ..... 270/53
4,515,458 5/1985 Masuda et al. .
4,549,804 10/1985 Braun et al. ..... 355/14 SH
4,564,185 1/1986 Hamlin et al. ..... 270/53
4,566,782 1/1986 Britt et al. .
4,573,789 3/1986 Wada .
4,582,421 4/1986 Hamlin et al. .
4,592,651 6/1986 OiKawa ..... 270/37
4,595,187 6/1986 Bober ..... 270/37
4,603,971 8/1986 Kukucka ..... 270/53
4,605,211 8/1986 Sonobe ..... 270/53
4,626,156 12/1986 Baughman et al. .
4,647,034 3/1987 Sawa ..... 271/293
4,647,188 3/1987 Komiya et al. .
4,674,732 6/1987 Hori ..... 270/53
4,674,866 6/1987 Tanaka .
4,687,191 8/1987 Stemmle ..... 270/53
4,702,589 10/1987 Ito .
4,718,657 1/1988 Otter et al. .
4,721,382 1/1988 Ito et al. .
4,730,206 3/1988 Sawada et al. .
4,743,945 5/1988 Ito et al. .
4,763,889 8/1988 Dei et al. .

PAPER HANDLING APPARATUS WITH A PAPER STAPLING FUNCTION

BACKGROUND OF THE INVENTION

1. Field of the Invention

The present invention relates to a paper handling apparatus, in particular, a paper handling apparatus for storing papers ejected from a copying machine or the like and stapling them by a stapler.

2. Description of Related Art

Generally, paper handling apparatuses of the type are of such arrangement that reproduced copying papers are stored onto a tray or like so that they are arranged in order thereon and, after stapling, they are transferred to a stacking station for being placed and stored therein. One such apparatus is disclosed, for example, in Japanese Patent Laid Open Publication No. 59-43765.

The apparatus is such that, after being stapled, the papers are relieved from the action of a stopper which regulates front ends of the papers and they are grasped between pinch rollers and large diameter rollers as the first mentioned rollers are caused to project into the tray, the papers being thereby discharged onto the stacking station.

With such apparatus, however, provision is required of special elements (such as rollers) for discharge of stapled papers and a mechanism for driving them which means that the apparatus is per se complicated in construction and larger in size.

In view of this problem, the present inventors made a series of studies into the possibility of developing a new upright type of paper handling apparatus in which papers are stored and arranged in order in generally vertically held condition for being stapled and processed otherwise. A paper handling apparatus of such upright type is advantageous in that less space is required for a paper working zone and, more especially, in that papers, after being stapled, can be discharged from the tray by being allowed to drop freely simply by relieving the action of a stopper positioned at the lower end of the tray. However, a mere attempt to allow free dropping of the papers may sometimes involve the trouble of positional irregularities in paper dropping if some constituent member is in contact with a paper or papers, which contact may causes a force of resistance. Especially when paper alignment means (e.g., a paddle wheel) for aligning papers in position for stapling purposes are in contact with some of the papers, such trouble is likely to occur.

Another possible difficulty is that if papers stored in an upright condition are irregularly positioned at upper ends thereof due to curling or their limpness, succeeding papers received for placement are likely to collide with the irregularly positioned papers, with the result of paper jamming. Further, in such case, the trouble is that the succeeding papers may individually break into the previously placed groups of papers, thus disturbing the order of paper placement.

Aforesaid conventional type of paper handling apparatus as, for example disclosed in said Japanese Patent Laid Open Publication No. 59-43765, employs an impeller like paddle wheel which is uni-directionally rotatable in order to align papers stored in the tray. However, such apparatus involves a problem that papers being transported by transport rollers into the tray reach the paddle wheel as they slip downward from the tray in free condition so that they may be subject to skewness depending upon the condition of their curling or their being statically electrified, which does not permit proper paper alignment.

SUMMARY OF THE INVENTION

In view of the above-mentioned problems, an object of the present invention is to provide a paper handling apparatus which is capable of discharging simply stapled papers from a tray to a stacking station without the trouble of positional irregularities.

Another object of the present invention is to provide a paper handling apparatus which is capable of resolving the problem about paper jamming and disorder of paper placement, regulating the upper portion of papers in accordance with the paper size vertically placed in the tray.

Still another object of the present invention is to provide a paper handling apparatus which is capable of transporting paper from transport means into a tray and aligning them without any trouble.

To attain the above object, a paper handling apparatus according to the present invention comprises a tray for storing papers ejected from an image forming apparatus, aligning means having a contacting member which contacts the surface of each paper being transported into the tray to urge the papers for alignment in a specified position, means for stapling the aligned papers by the aligning means, means for discharging the stapled papers from the tray, and means for relieving the contact between the contacting member and the papers when the discharging means is actuated in operation.

According to this structure, papers ejected from the image forming apparatus are transported one by one into the tray, in which they are aligned in the specified position by the aligning means. When a predetermined number of papers have been received and aligned, the stapling means is operated to staple the papers. Subsequently, the papers are discharged from the tray by the discharging means. In this case, the contacting member is relieved from its contact with the papers. Therefore, the stapled papers which are stored generally upright in the tray are discharged smoothly from the tray without being interfered with by the contacting member so that they are stacked in a basket or the like which is provided below the tray. It is noted that the contact between the contacting member and papers need not completely be removed so that the pressure of contact present is reduced to zero. The contact pressure must be reduced to such extent as to permit the stapled papers to be discharged without difficulty.

Further, a paper handling apparatus according to the present invention comprises a tray for storing papers ejected from an image forming apparatus in substantially vertical position which has an alignment reference member in its lower portion, means for transporting the ejected papers into the tray from above, a plurality of pressing means for pressing the transported papers at the upper portion thereof against the tray, each of the pressing means is individually adapted correspondingly to the sizes of papers, control means for actuating the pressing means in conjunction with the operation of the transport means correspondingly to the sizes of papers, means for aligning each paper being transported into the tray along the alignment reference member, and means for stapling the aligned papers.

According to this structure, individual papers are held in position at their upper portion under pressure by the pressing means according to their size, so that such trouble as paper jamming or papers transporting into previously received groups of papers can be prevented.

Further, a paper handling apparatus according to the present invention comprises a tray for storing and aligning ejected papers form an image forming apparatus, means for transporting the ejected papers into the tray, means for stapling the stored papers in the tray, and aligning means arranged at a location less distant from the transport means than the length of paper in the direction of transporting paper on the tray, and for applying the transporting force to the paper so that when the rear end of the paper being transported into the tray leaves from the transport means, the angle defined by the direction of the transporting force given to the paper and a front end alignment reference line for the paper is smaller than the angle defined by a straight line connecting the corner portion of the paper and an alignment corner portion and the front end alignment reference line According to this structure, each paper being transported by the transport means toward the tray is brought into contact with the aligning means while its rear end is still held on the transport means, and as the rear end leaves the transport means, the paper is urged by the aligning means toward the alignment corner portion for being transported thereto In this case, by virtue of the aligning means, the paper is subjected to the transporting force generally parallel to a straight line connecting the corner portion of the paper and the alignment corner portion, and under this transporting force one side of the paper goes in abutment with a regulating member which defines a side alignment reference line for the paper; thus, the paper is subsequently brought in proper alignment with other papers at the alignment corner portion.

BRIEF DESCRIPTION OF THE DRAWINGS

These and other objects and features of the present invention will become apparent from the following description taken in conjunction with preferred embodiments thereof with reference to the accompanying drawings, in which:

FIG.1 through FIG.21 show a first embodiment of the present invention;

FIG.1 is an internal composition of a finisher unit;

FIG.2 and FIG.3 are elevational views respectively taken in the direction of the arrow E in FIG.1;

FIG.4 is a perspective view of pressing members;

FIG.5 and FIG.6 are explanatory drawings showing paper transporting into a stapling tray;

FIG.7 is a perspective view of a paper float-up restraining roller;

FIG.8 is a perspective view of a driving mechanism for a paddle wheel;

FIG.9 is a schematic block diagram showing the finisher unit with a stack unit;

FIG.10 is a schematic block diagram showing a copying machine and the finisher unit;

FIG.11 is a plan view showing an control panel of the copying machine;

FIG.12 is a plan view showing an control panel of the finisher unit;

FIG.13 is a diagram showing a control circuit;

FIG.14 is a flow chart showing a main routine of a first CPU;

FIG.16 is a flow chart showing a subroutine for signal processing;

FIG.17 is a flow chart showing a main routine of a second CPU;

FIG.18 is a flow chart showing a subroutine for canceling a stapling mode;

FIG.19 is a flow chart showing a subroutine for mode setting;

FIG.21 is a flow chart showing a subroutine for paper stapling/stacking;

DETAILED DESCRIPTION OF THE INVENTION

Figure 1:
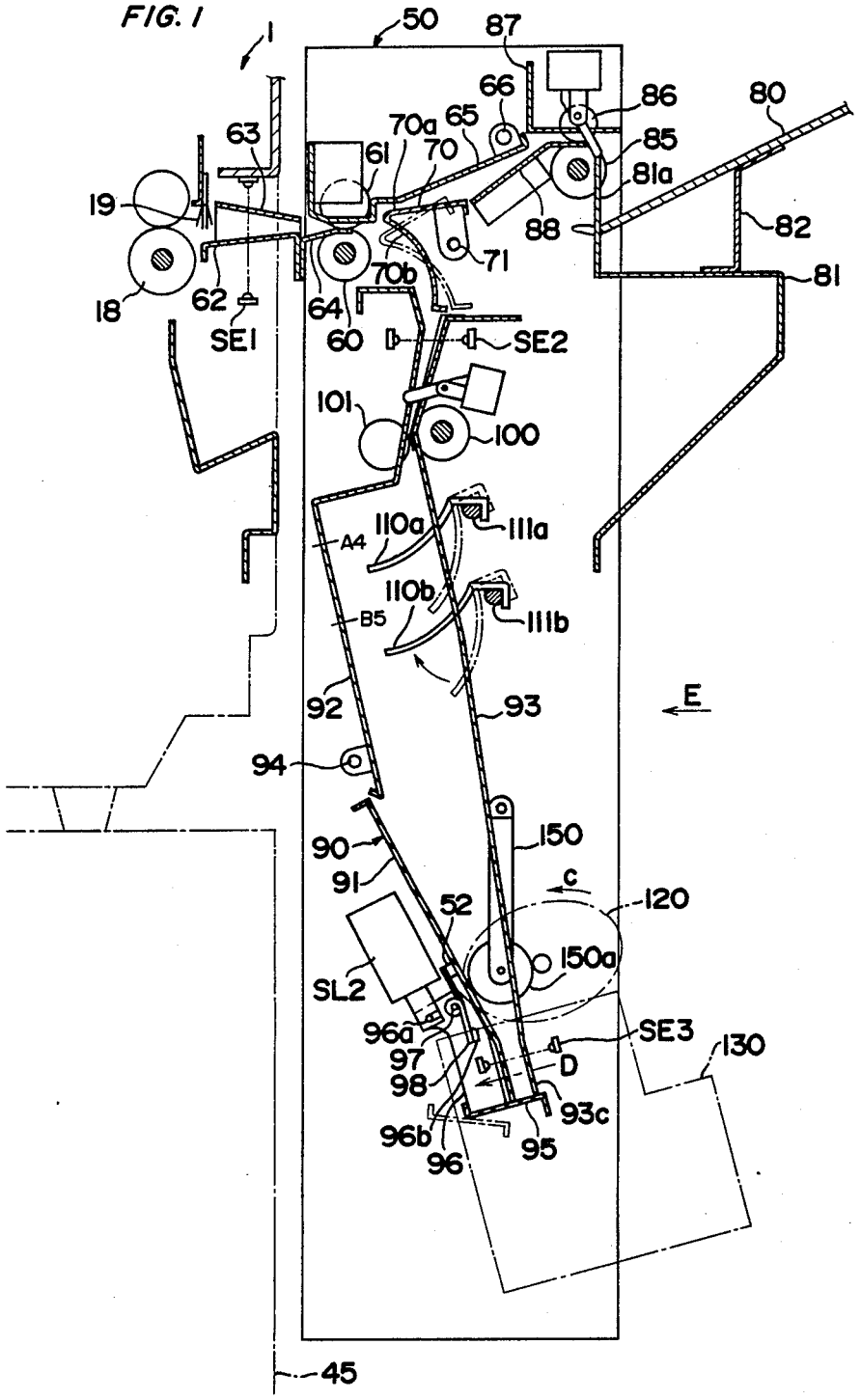

Before the description of the present invention proceeds, it is to be noted that like parts are designated by like reference numerals throughout the accompanying drawings.

[First Embodiment]

The embodiment of a paper handling apparatus according to the invention is described, below, by referring to the accompanying drawings. (General constitution including copying machine and ADF)

Figure 10:
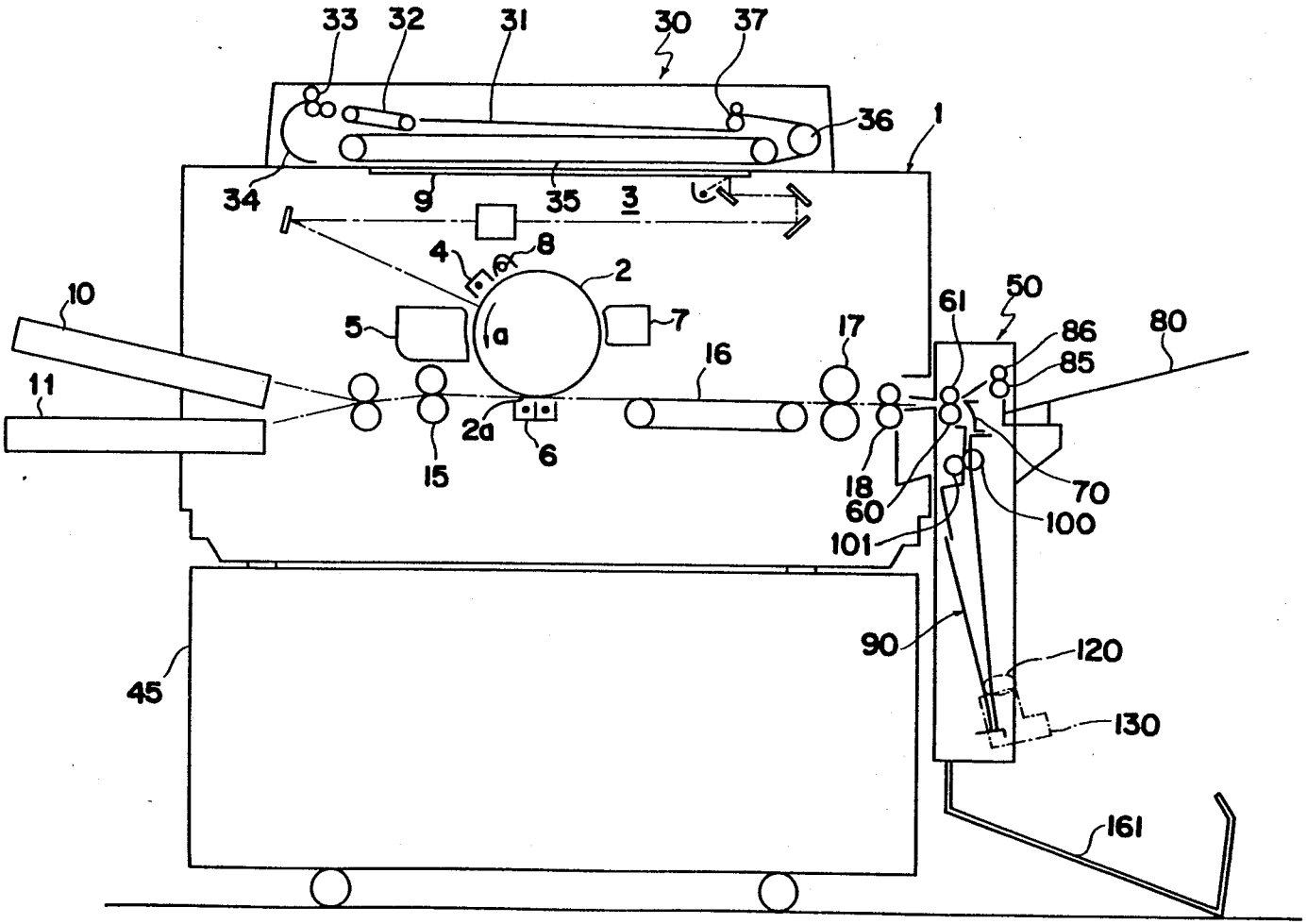

First, the general constitution of a copying machine 1 is described, by referring to FIG.10.

The copying machine 1 is placed on a desk 45, and an automatic document feeder 30 with a document circulating function, which is hereinafter referred to as ADF is disposed on the top surface thereof. Inside the copying machine 1, there is a photosensitive drum 2 rotatable in the arrow (a) direction. Around the drum 2, such well known image forming elements are arranged as an optical system 3, an electrifying charger 4, a developing device 5, a transfer charger 6, a cleaning device 7, an eraser lamp 8 and others. These elements and the copying processes of the elements are so well known that the detailed description of them is omitted.

Copying papers which are loaded in automatic paper feeder cassettes 10 and !1, are fed sheet by sheet from a specific cassette selected from the cassettes 10 and 11. Then, by a pair of timing rollers 15, a copying paper is synchronized with a toner image formed on the circumferential surface of the photosensitive drum 2 and is transported to a transfer portion 2*a*. After the transfer processing, the copying paper is supplied to a fixing device 17, by a conveyor belt 16, where toner image is fixed, then the paper is ejected by a pair of ejection rollers 18.

The ADF 30 generally comprises a document deck tray 31, a document feeder belt 32, a Pair of document feeder rollers 33, a diverting guide plate 34, a transPort belt 35, a diverting roller 36 and a pair of ejection rollers 37. The ADF 30 transports one set of documents sheet by sheet from the last page. One set of documents is placed on the tray 31, with the reverse side of the last page positioned downward, and drawn out sheet by sheet from the last page by the travel of the feeder belt 32. Then, the document is fed to between the transport belt 35 and a document deck glass 9, via the pair of document feeder rollers 33 as well as the diverting guide plate 34. Next, the document is set at a specified position on the document deck glass 9 by the travel of the transport belt 35 to be subjected to one sequence of irradiation with the optical system 3. After the image exposure, the document is transported by the transport belt 35 from the document deck glass 9 toward the right side in FIG.10, where diverted by the diverting roller 36, then ejected by the pair of ejection rollers 37 onto the stack of other documents placed on the tray 31, with the surface having an image is upward.

Incidentally, one sequence of the image exposure is defined as one cycle of copying operation.

Figure 11:
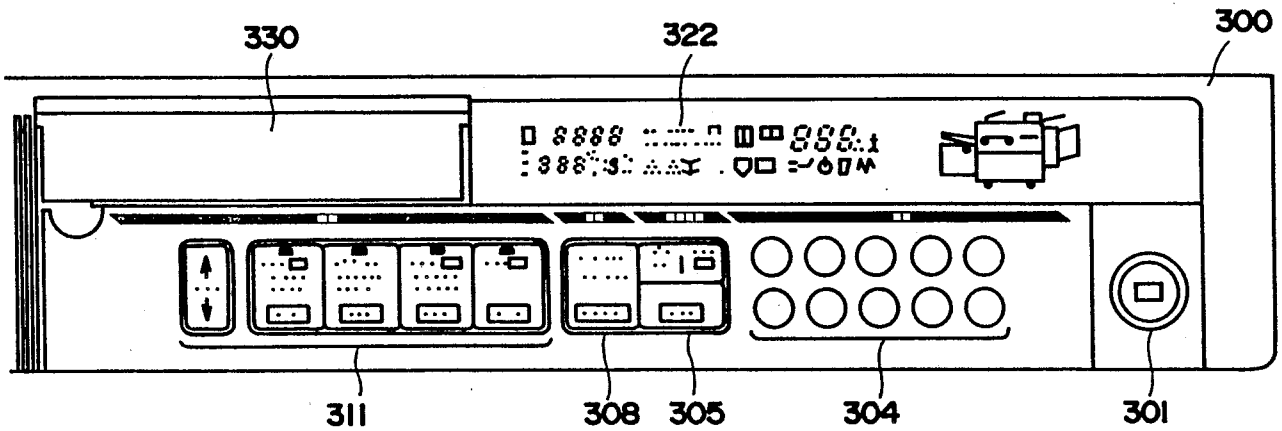

The ADF 30 repeats one cycle of copying operation up to the number of cycles which has been entered with ten numerical keys 304 shown in FIG.11. Additionally, the number of documents to be duplicated in one cycle of copying operation is also entered with the numerical keys 304. Further, the ADF 30 is disposed to be freely lifted from and lowered onto the copying machine 1. Therefore, with the ADF 30 in the lifted position, a document can be manually set, for a copying operation, on the document deck glass 9. The ADF 30 does not operate when lifted. Lifting the ADF 30 is detected by an unshown switch located in the vicinity of the document deck glass 9.

With a paper handling apparatus in this embodiment of the invention, copying papers ejected from the copying machine 1 are selectively received either by an ejection tray 80 or by a stapling tray 90, where aligned, then stapled with a stapler 130. Accordingly, once a plurality of sets of copying papers are duplicated in used the ADF 30 and to stapling operation, these sets of copying papers are sequentially stored on the stapling tray 90. Then, when one cycle of copying operation has completed, the stapler 130 is actuated based on a stapling signal outputted from the copying machine 1, in order to staple one set of copying papers. The one set of copying papers staPled is stacked in a stack box 161.

(Control panel of copying machine)

Now, a control panel 300 of the copying machine 1 will be explained with reference to FIG.11. The control panel 300 is disposed in the upper front portion of the copying machine 1 and has a print key 301 for initiating a copying operation, a ten-key 304 for use in setting necessary number of copy sets, the number of originals to be copied, necessary magnification, etc., an exposure setting key 305 for setting copy image density, a selector key 308 for switching paper feed to and from the upper cassette 10 or lower cassette 11, and magnification setting keys 311 for setting copy magnification. Special input keys, such as a magnification operation key, a zoom memory setting key, a zoom memory key, and a book copying key, are covered with an open/-close cover 330, and they are operable only when the open/close cover 330 is opened. Shown by 322 is a display panel for indicating required number of copy sets, magnification, paper size, etc.

(Constitution of finisher unit)

The constitution of a finisher unit 50 is hereinafter described by referring to FIG.1 through FIG. 7.

The finisher unit 50 generally comprises rollers 60 and 61 for receiving a copying paper, a diverting member 70 for diverting a transport course, a paper ejection tray 80, paper ejection rollers 85 and 86 for ejecting a copying paper onto the ejection tray 80, a stapling tray 90, paper transport rollers 100 and 101 for transporting a copying paper to the stapling tray 90, pressing members **110*a* and 110*b* capable of pressing the upper portion of papers stored in the stapling tray 90, a paddle wheel 120 for aligning a copying paper stored in the stapling tray 90 relative to a corner portion (A) and a stapler 130**.

A portion to receive a copying paper ejected from the copying machine 1 comprises, in addition to the above mentioned rollers 60 and 61, guide plates 62 and 63 laterally opposing to the pair of ejection rollers 18, and a guide plate 64 provided within the finisher unit 50. A guide plate 65 extends from the receiving portion to the ejection rollers 85 and 86. The guide plate 65 can be lifted upward on a pivot 66, so as to enable various procedures such as the removable of jammed papers. The roller 61 is mounted on the guide plate 65.

Incidentally, an ejection portion of the copying machine 1 has a neutralizing brush 19, and a photosensor SE1 which detects a copying paper.

As shown in FIG.1, the bill-shaped diverting member 70 is pivotally attached to a pivot 71, thereby turning on an unshown solenoid shifts the member 70 from a position shown by the dashed line to a position shown by the solid line. At the position of the dashed line, the diverting member 70 leads a copying paper to the paper ejection tray 80 side along the top surface **70*a* of the member 70. At the position of the solid line, the diverting member 70 leads a copying paper to the stapling tray 90 side along the inwardly curved surface 70*b***.

The paper ejection tray 80 is secured on the exterior of the finisher unit 50 through support plates 81 and 82. The bottom end of the paper ejection tray 80 is located below the ejection rollers 85 and 86 and intersects with a stopper **81*a* to stop the trailing edge of coPying paper Near the ejection rollers 85 and 86, guide plates 87 and 88 are disposed, while the ejection roller 86 is attached to the guide plate 87**.

The stapling tray 90 comprises a main base plate 91, a guide plate 92, and a guide plate 93 facing both the main base plate 91 and the guide plate 92, and a stopper 95. The stapling tray 90 is disposed upright, slightly leaning toward the left. The upper portion of the guide plate 92 extends toward the vicinity of the inwardly curved surface **70*b* of the diverting member 70 and can be pivotally opened up counterclockwise on a pivot 94 in FIG.1 so as to allow procedures such as the removable of jammed paper. The upper portion of the guide plate 93 opposes the upper portion of the guide plate 92 via a narrow space, and extends toward directly below the diverting member 70. To the lower portion of the guide plate 93, an area 93*c* faces the base plate 91 at the position lower than that of a paddle wheel 120 mentioned later, with the narrower space compared with other areas. More specifically, the space between the area 93*c* and the base plate 91 is slightly larger than the thickness of a specified number of copying papers which can be stored in the stapling tray 90. The reason for why the thickness in an area corresponding with the paddle wheel 120** is narrower and the thickness in the other areas are larger is that it is intended to minimize the friction exerted between the already stored and aligned copying papers and the currently aligned paper in order to ensure that all the copying papers aligned to alignment reference lines (A1) and (A2).

Additionally, the above mentioned area is provided a photosensor SE3 for detecting a copying paper transported into the stapling tray 90.

The stopper 95 forms the bottom Plate of the stapling tray 90, and is rotatably attached to a pivot 97 through an arm 96. The arm 96 is connected with a solenoid SL2 via a pin 96*a*, thereby both ends of a torsion spring 98, coiled around the pivot 97, is engaged respectively with a projection 96*b* on the arm 96 and a projection 52 on the frame 51. Therefore, as shown in FIG. 1, when the solenoid SL2 is in the off status, the stopper 95 is in a shown by the solid line in FIG.1 and closes the bottom of the stapling tray 90. On the other hand, once the solenoid SL2 is turned on, the stopper 95 pivotally moves on the pivot 97 to a position shown by the dashed line to open the bottom of the stapling tray 90.

The transport rollers 100 and 101 are disposed at the area where the space between the upper portions of the guide plates 92 and 93 is the narrowest. The transport rollers 100 and 101 transport a copying paper guided downwards along the inward curved side 70*b* of the diverting member 70. A photosensor SE2 for detecting a copying paper is disposed immediately above the similar rollers 100 and 101.

Additionally, the nip portion between the transport rollers 100 and 101 is arranged so that a copying paper nipped may face the guide plate 93 side. This arrangement is provided in order to reduce the contact friction between a copying paper being transported into the stapling tray 90 and copying papers already stored in the tray 90.

Figure 7:
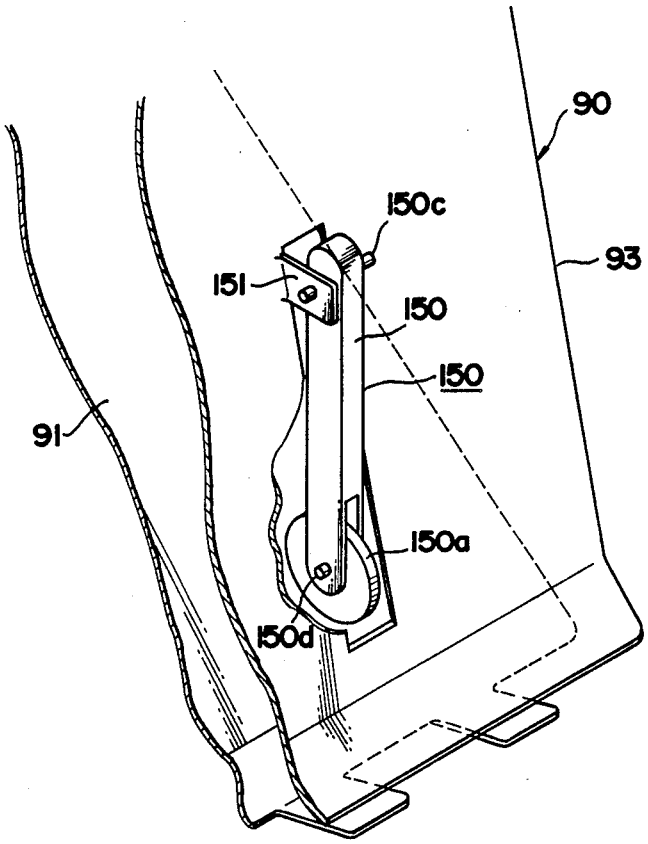

A float-up restraining member 150 as shown in FIG.7 is provided in the lower portion of the stapling tray 90 in order to prevent such poor alignment and paper jamming that may otherwise occur when individual copying papers stored generally upright, which have become bent at their lower end by their own weight or due to curling, are brought into contact with a succeeding paper received. The float-up restraining member 150 comprises an arm 150*b* pivotally supported about a support shaft 150*c* through a support plate 151 mounted to the guide plate 93, and a roller 150*a* rotatably mounted to the arm 150*b* through a pin 150*d*. This float-up restraining member 150 is mounted in such a position that when, as in FIGS. 2 and 3, copying papers of a minimal size possible for placement are aligned in position at the alignment corner portion (A), the roller 150*a* can press the copying papers by its own weight or biasing force against the alignment corner portion (A) at the lower end side of the copying papers in the vicinity of the stopper 95. That is, any bend at the lower end of copying papers is straightened out by being pressed by the roller 150*a*, so that possible interfacial contact between the copying paper received in position can be minimized, orderly paper accommodation being thus assured.

Figure 4:
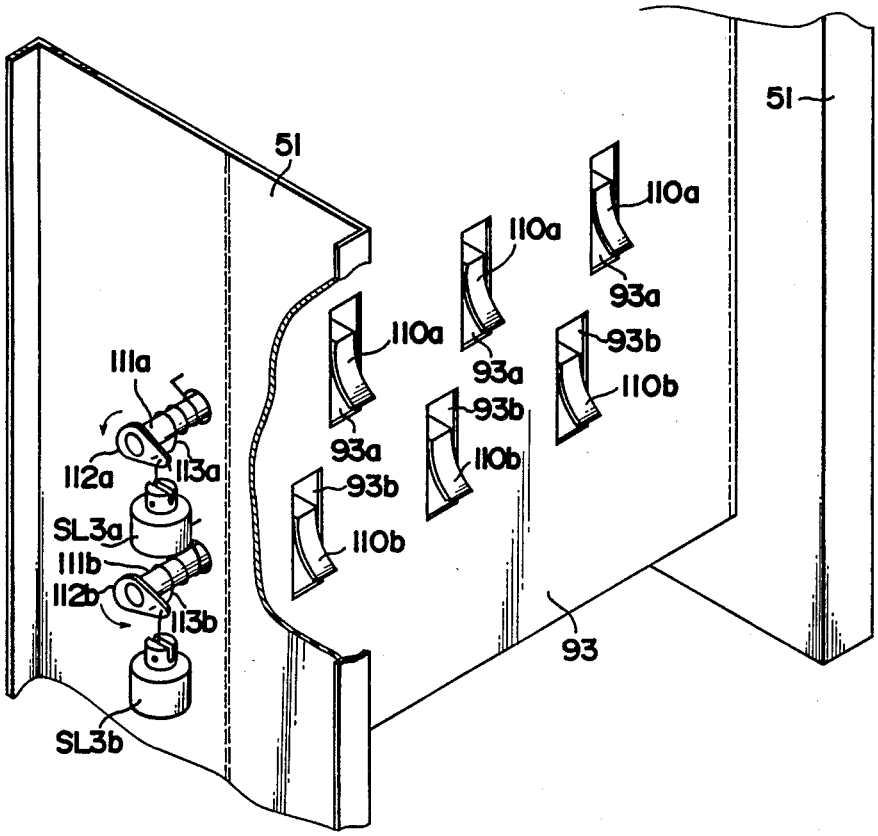

On the other hand, a plurality of pressing members 110*a* and 110*b*, as shown in FIG.4, are fixed respectively to support shafts 111*a* and 111*b* mounted rotatably to frames 51 and 51, the shafts 111*a* and 111*b* being connected respectively to solenoids SL3*a* and SL3*b* through arms 112*a* and 112*b* biased by torsion springs 113*a* and 113*b* in the direction of the arrow shown in FIG.4. Therefore, the pressing members 110*a* and 110*b* are urged by the torsion springs 113*a* and 113*b* toward their pressing position while the solenoids SL3*a* and SL3*b* are in the off status, whereas they are pivotally moved about the support shafts 111*a* and 111*b* when the solenoids SL3*a* and SL3*b* are turned on, the pressing members 110*a* and 110*b* being thus retracted from windows 93*a* and 93*b* of the guide plate 93. The pressing members 110*a* and 110*b* are positioned adjacent to the upper portion of copying papers as stored in the stapling tray 90 and they are so configured as to guide copying papers smoothly into the stapling tray 90.

Figure 2:
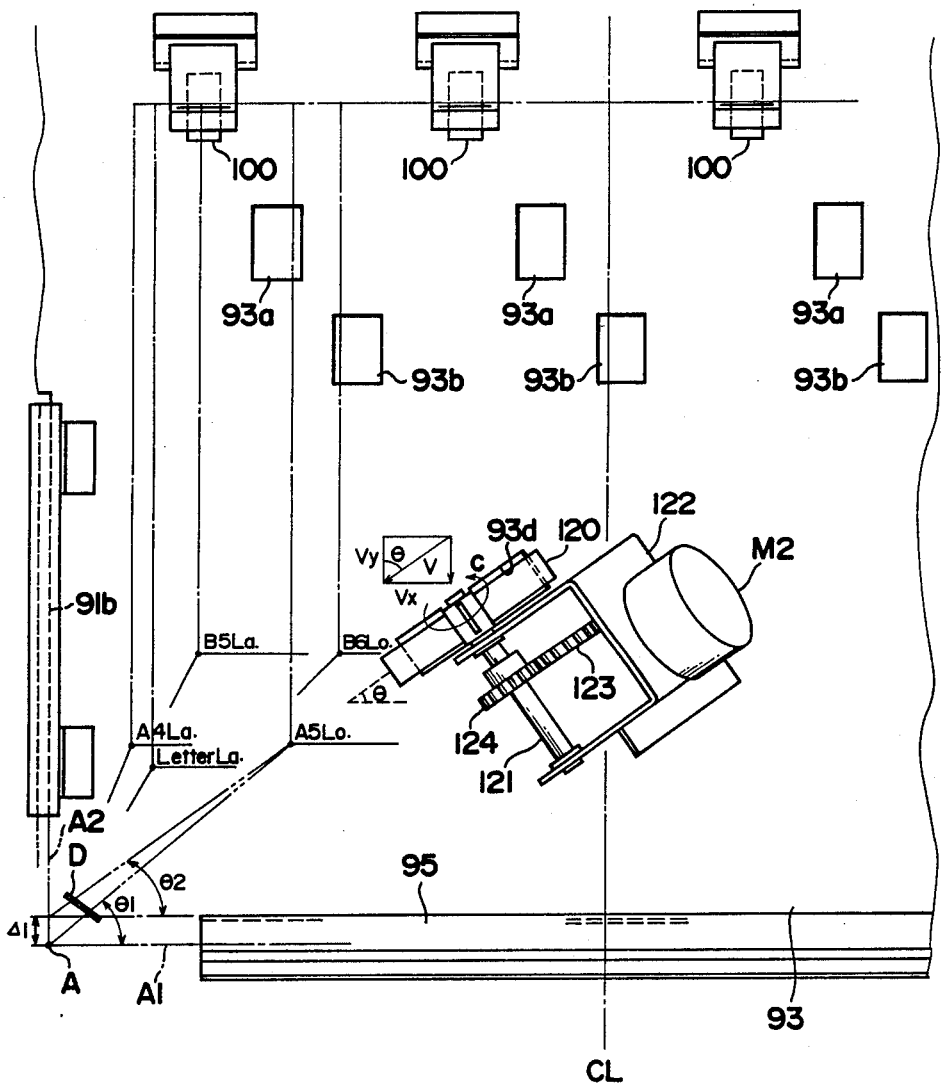
Figure 3:
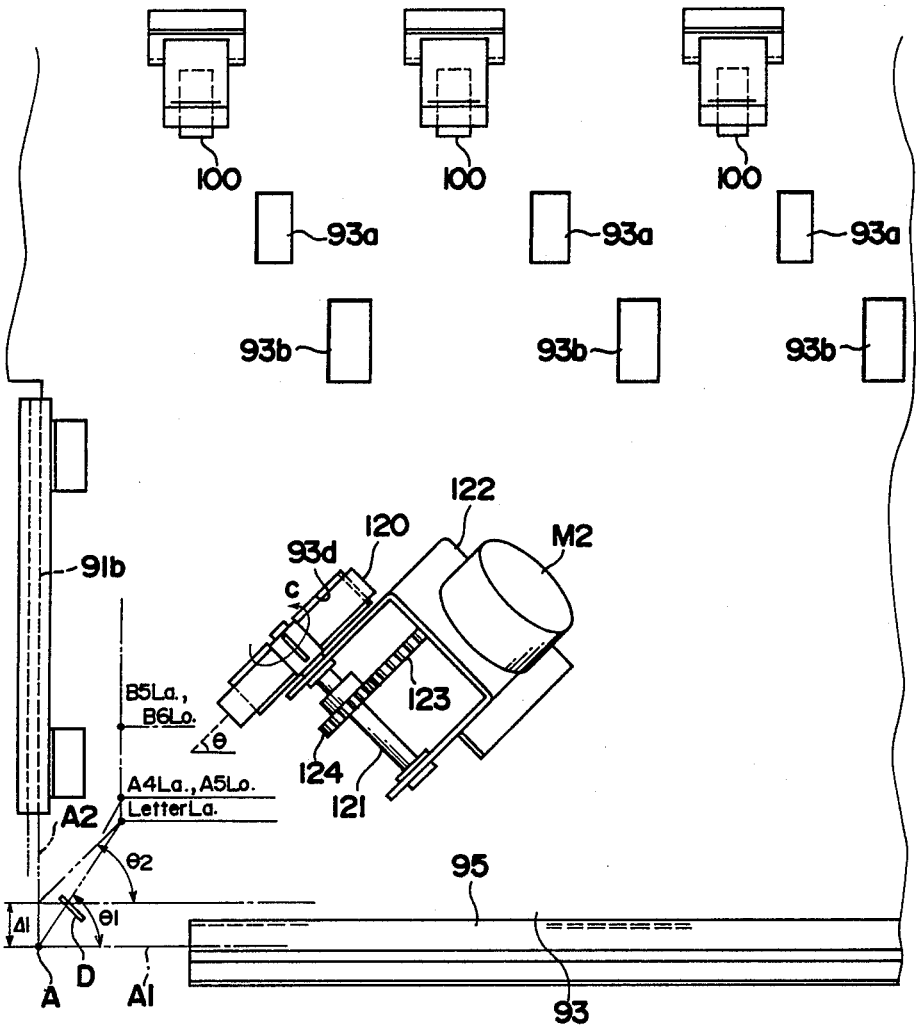
Figure 8:
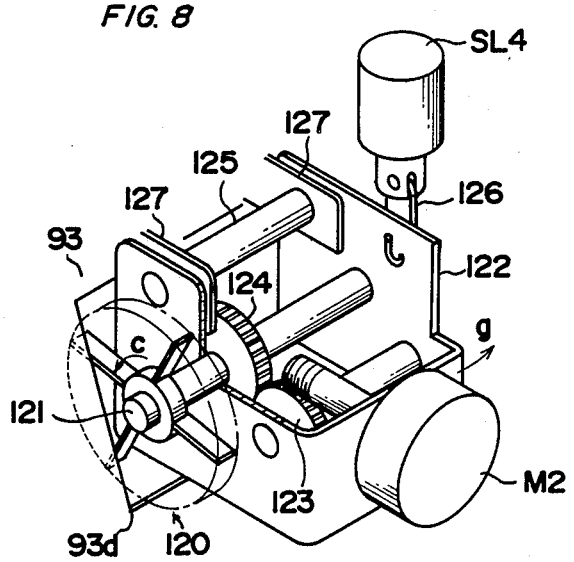

In FIGS.2, 3 and 8, the paddle wheel 120 whose top is equipped with a plurality of radially-arranged flexible blades (rubber plates) is disposed at an angle of $\theta$ to the transporting direction on the surface for a copying paper. An axle 121 of the paddle wheel 120 is rotatably attached to a bracket 122 arranged to the exterior of the guide plate 93. A part of the paddle wheel 120 protrudes through a long hole 93*d* formed on the guide plate 93 into the stapling tray 90. A motor M2 mounted on the bracket 122, and being rotatable in forward and reverse directions is connected with a gear 123 through an unshown reducing means. The gear 123 meshes with another gear 124 fixed to the axle 121, accordingly the paddle wheel 120 is rotatable in forward and reverse directions.

More specifically, the paddle wheel 120 rotating in the arrow (c) direction shifts a copying paper, which has been transported into the stapling tray 90, toward the corner portion (A) where the reference lines (A1) and (A2) intersect with each other. In this case, the peripheral velocity (V) of the paddle wheel 120 is predetermined so that the vertical component (Vy) is larger than the peripheral velocity of the transport roller 100. However, the transporting force of the paddle wheel 120 is predetermined so as to be weaker than that of the transport rollers 100 and 101. Therefore, the transporting force of the paddle wheel 120 exerted on a copying paper and derived from the rotation in the direction of the arrow (c) works after the trailing edge of the copying paper had passed the nip portion between the rollers 100 and 101. The positions of the corner portions of the copying papers which have passed the rollers 100 and 101 are indicated by B5LA., B6Lo., A5Lo., A4La. and letter La. according to their different sizes in FIG. 2. Incidentally, said "La." means that copying paper is latitudinal positioned, and said "Lo." means that copying paper is longitudinal positioned. Additionally, the copying papers are transported based on the center line (CL) as a reference line. Where the copying papers are transported on an unilateral alignment basis, the corner portions of the copying papers are positioned at the positions shown in similar manner in FIG. 3.

The inclination $\theta$ of the paddle wheel 120 is predetermined so that the trailing edge of a copying paper, when it has passed the transport rollers 100 and 101 and the transporting force of the paddle wheel 120 starts exerting on the paper, an angle $\theta 2$ defined by the direction of the transporting force exerted by the paddle wheel 120 toward (V) and the front end alignment reference line (A1) is equal to or smaller than the minimal one $\theta 1$ of angles defined between a straight line connecting the corner portion of copying paper and the alignment corner portion (A) and the reference line (A1). The minimal angle $\theta 1$ corresponds to A5Lo. size in the case of transporting paper on a center alignment basis as shown in FIG. 2, and where papers are transported on an unilateral alignment basis as shown in FIG. 3, it corresponds to letter La. size.

By this is meant that each copying paper is allowed to take the shortest possible course to the alignment corner portion (A), or it is first brought in abutment with a regulating plate 91*b* which defines a side alignment base line (A2) and it is brought to the alignment corner portion (A), in order to provide improved alignment.

Therefore, when a copying paper of A5Lo. or letter La. which corresponds to the minimal angle (θ1) is carried by the paddle wheel 120 after its leaving the transport rollers 100 and 101, the paper first goes in abutment with the side regulating plate 91b at an upstreamside point which is (Δ1) away from the alignment corner portion (A) and then reaches the alignment corner portion (A) while being guided by the side regulating plate 91b. Copying papers of all other sizes go into abutment with the side regulating plate 9a at an upstreamside point which is more than (Δ1) away. In other words, the relationship between angles (θ1) and (θ2) is set so that copying papers of any size are prevented from first reaching the front end alignment reference line (A1).

Additionally, the positional relation in the vertical direction between the paddle wheel 120 and the pair of transport rollers 100 and 101 must be arranged so that a copying paper is subjected to the transporting force of either the paddle wheel 120 or the pair of transport rollers 100 and 101.

The stapler 130 is a well-known electric type, wherein a receiver unshown is disposed on the plane common to the base plate 91 of the stapling tray 90 to staple one set of copying papers stored and aligned in the stapling tray 90.

(Operation of the finisher unit)

The operation of the finisher unit 50 is described, below.

(Non-stapling mode)

The non-stapling mode is an operation mode to stack and store copying papers, which have been ejected from the pair of ejection rollers 18 on the copying machine 1, onto the paper ejection tray 80, without a stapling operation.

In this mode, the diverting member 70 is at the position shown by the dashed line in FIG. 1, thereby a copying paper received by the rollers 60 and 61 is guided both by the top side 70a of the diverting member 70 and by the guide plate 65, then is ejected by the paper ejection rollers 85 and 86 onto the paper ejection tray 80.

(Stapling mode)

Figure 9:
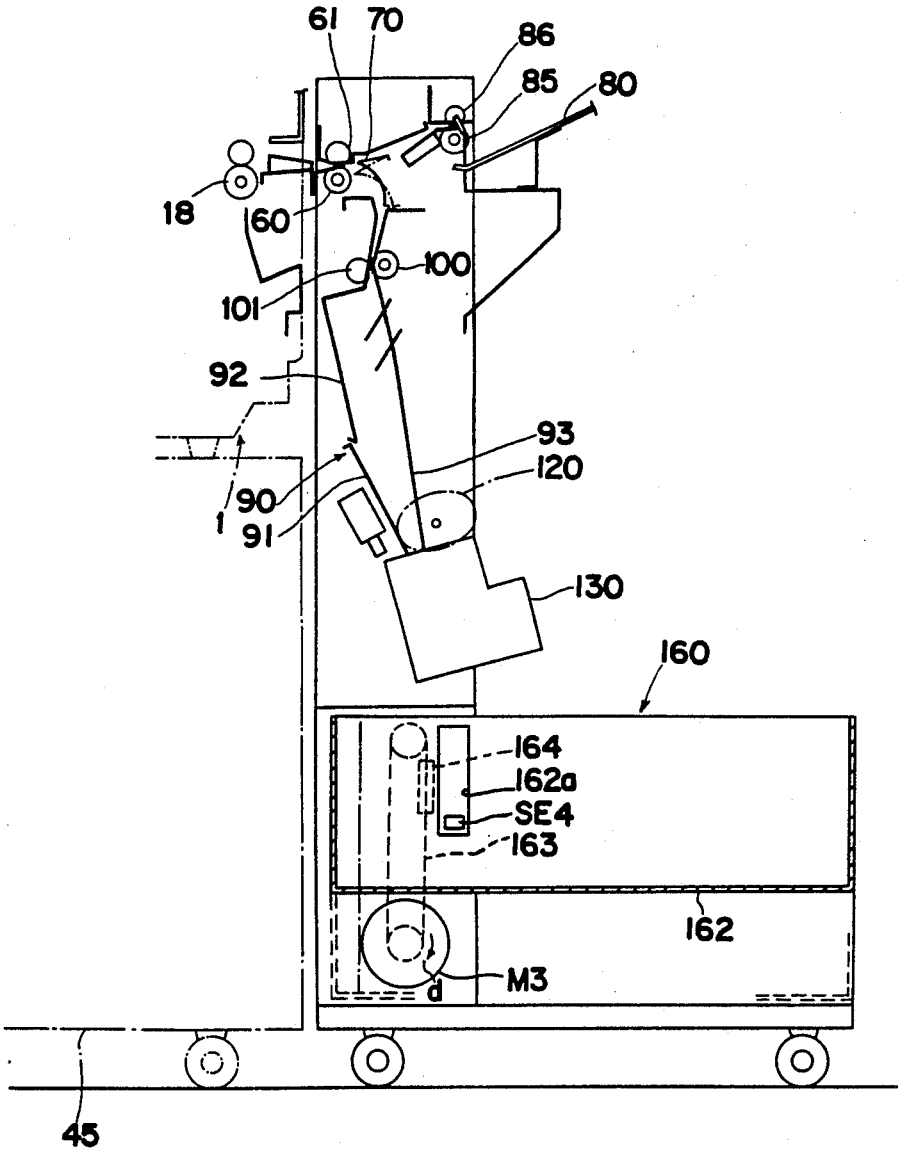

The stapling mode is an operation mode where copying papers are stored and aligned in the stapling tray 90 and are stapled with the stapler 130, then are stacked in a stack box 161 (see FIG. 10) or in a stack unit 160 (see FIG. 9).

In this mode, the diverting member 70 is shifted to the position shown by the solid line in FIG. 1, thereby a copying paper introduced by the rollers 60 and 61 is guided both by the inwardly curved side 70b of the diverting member 70 and by the upper portions of the guide plates 92 and 93, and is transported by the rollers 100 and 101 into the stapling tray 90. Synchronously with the rotation of the transport rollers 100 and 101, the paddle wheel 120 is actuated to rotate forward in the direction of the arrow (c), thereby the copying paper whose trailing edge has left the rollers 100 and 101 receives the transporting force by the rotation of the paddle wheel 120 and moves toward the corner portion (A), where aligned. During this course, the copying paper receives the transporting force at the nip portion so as to face the guide plate 93 side based on the predetermined direction of the nip portion.

Incidentally, when a copying paper is stored as it has been curled due to the heating of the fixing device 17 and if the upper portion of the paper is warped toward the guide plate 93, the next paper being transported interferes with the upper portion of the curled paper already stored, thereby causing paper jamming. In order to prevent this trouble, the first embodiment provide an arrangement, wherein the pressing members 110a and 110b press the upper portion of the already stored copying papers. The pressing members 110a correspond to A4 La., A5Lo. and letter La., and the pressing members 110b correspond to B5La. and B6Lo.

Figure 5:
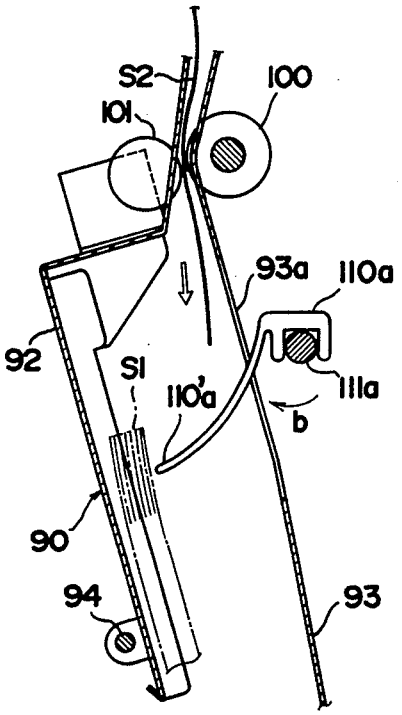
Figure 6:
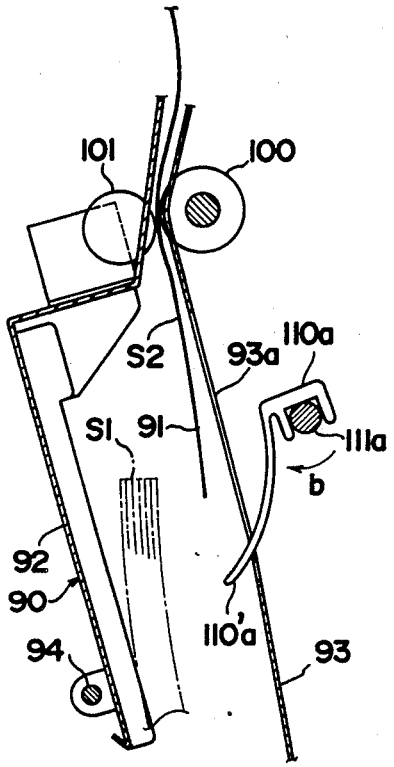

More specifically, when a specified period has elapsed since the leading edge of a copying paper is detected by the photosensor SE2, for example, at the timing when the paper is aligned in the corner portion (A) by the rotation of the paddle wheel 120, the solenoid SL3*a* or SL3*b* is turned on, thereby the pressing member 110a or 110b in connection with the paper size pivotally moves on the pivot 111a or 111b in the direction of the arrow (b), and the top portion 110'a or 110'b of the pressing member 110a or 110b protrudes into the stapling tray 90 through the window 93a or 93b on the guide plate 93 so as to press the upper portion of the papers S1 already stored (see FIG. 5). Consequently, the upper portion of the curled papers S1 is pressed toward the bottom of the stapling tray 90, that is, toward the guide plate 92, in order to correct the curl of the papers S1.

Further, since the solenoid SL3*a* or SL3*b* is turned off at least immediately before the leading edge of the next paper S2 reaches the vicinity of the pressing member 110a or 110b, the pressing member 110a or 110b pivotally moves in the direction reverse to the arrow (b) so as to cancel the pressing force on the stored papers S1.

The above mentioned operation corrects the curled upper portion, of the copying papers S1 already stored in the stapling tray 990, which faces the guide plate 93 side, and successfully prevents the jammed papers which may be caused by the interference between the copying paper S2 next transferred into the stapling tray 90 and the already stored and curled papers S1.

The manner of operation of the pressing members 110a and 110b varies according to the sizes of copying papers. That is, if the papers to be received in position are of A4La., A5Lo. or letter La. the upperside positioned pressing members 110a are moved in manner as above described, while the lowerside positioned pressing members 110b are retracted from the stapling tray 90. If the papers are of B5La. or B6Lo., the upperside positioned pressing members 110a are retracted from the stapling tray 90, whereas the lowerside positioned pressing members 110b are moved in the above described manner.

The above operation enables copying papers to be stored and correctly aligned in the stapling tray 90 sheet by sheet in the order of page while the copied image on each paper faces to the guide plate 93 side. When the previously mentioned ADF 30 with a document circulating function is used, the stapler 130 is actuated based on a stapling signal outputted at the timing synchronized with the completion of one cycle of copying operation and staples the copying papers at the stapling position (D). When the ADF 30 is not used, the stapler 130 is actuated and similarly staples the papers based on a stapling signal inputted by an operator.

Once the stapling operation has completed, the solenoid SL2 is turned on, and the stopper 95 retreats to a position indicated by the dashed line shown in FIG. 1 so as to open the bottom of the stapling tray 90. Therefore, the stapled one set of papers is discharged downward from the stapling tray 90 because of the own weight.

As described above, the one set of copying papers discharged from the stapling tray 90 is stacked in the stack box 161 shown in FIG. 10 or in the stack box 162 of the stack unit 160 shown in FIG. 9.

In the first embodiment, the base plate 91 of the stapling tray 90 is fixed at a position shown by the solid line in FIG. 1. The paddle wheel 120 is arranged as shown in FIG. 8. That is, the bracket 122 is pivotally mounted to lugs 127 and 127 fixed to the guide plate 93 through a support shaft 125, a plunger of a solenoid SL4 is connected to the bracket 122 through an arm 126.

When the solenoid SL4 is in the off condition, the paddle wheel 120 is urged by the own weight of the motor M2 and otherwise toward the base plate 91 so that it plunges into the stapling tray 90 for contact with a copying paper as it is transported into the stapling tray 90, thereby to exert the transporting force on the paper. After stapling and immediately upon or immediately prior to the action of the stopper 95 is relieved, the solenoid SL4 is turned on so that the bracket 122 is rotated on the support shaft 125 toward the direction of the arrow (g). Thereupon, the contact of the paddle wheel 120 with the copying papers is relieved.

That is, in this first embodiment, the paddle wheel 120 is retracted outwardly so that it is relieved of its contact with the papers. According to this embodiment, the unit including the paddle wheel 120 as a whole is pivotally movable so that as copying papers stored in the stapling tray 90 increase in number, the entire unit retracts, whereby it can maintain a constant pressure relative to the papers and irrespective of the number of papers stored in the stapling tray 90, satisfactory alignment of the papers being thus assured.

When one set of the copying papers is discharged from the stapling tray 90, the operations of the ADF 30 and the copying machine 1 restart to execute the next copying operation. Such a sequence of operations, including one cycle of copying operation and an operation of stapling papers prepared in the one cycle of copying operation, are repeated up to the number of sequences entered with the ten numerical keys 304.

(Constitution and operation of stack unit)

The stack unit 160 is described, below, by referring to FIG. 9.

The stack unit 160 is so arranged that the stack box 162 is connected through a fixture 164 to a belt 163 which is actuated by a motor M3 to rotate in the forward and reverse directions, in order to allow the upward or downward adjustment of the unit 160. Additionally, a photosensor SE4 for detecting the set of copying papers is aligned to openings 162*a* provided on both sides of the stack box 162 to detect the height of sets of copying papers stacked in the stack box 162.

More specifically, when each set of copying papers having been stapled is discharged from the stapling tray 90 and sequentially stacked in the stack box 162, and if the sensor SE4 detects the top of copying papers, the motor M3 is actuated to rotate in the direction of the arrow (d) and the stack box 162 moves downward in accordance with the rotation of the belt 163. As the stack box 162 moves downward, the top of copying papers is unlocked from the optical axis of the sensor SE4 and turns off the sensor SE4, this is, turns off the motor M3. Therefore, every set of copying papers is without fail discharged and stacked at a constant height.

(Control panel of finisher unit)

Figure 12:
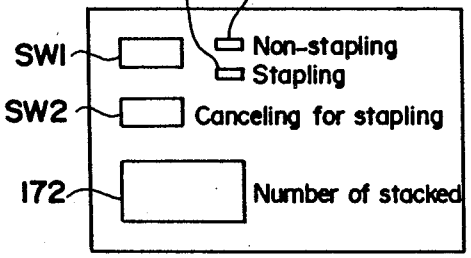

A control panel of the finisher unit 50 is described, below, by referring to FIG. 12.

SW1 is a mode select switch, and numeral 170 represents a non-stapling mode indicator LED, and numeral 171 represents a stapling mode indicator LED. In the starting stage, the non-stapling mode is started as a default mode. Every time the select switch SW1 is pressed, the stapling mode and the non-stapling mode are alternately designated, thereby the indicator LED 170 or 171 correspondingly lights up.

When using the previously mentioned ADF 30 to execute the stapling mode, the timing or the like of the stapling operation is automatically designated by communication between the ADF 30 and a controller on the copying machine 1, as described below. In contrast, when the ADF 30 is not used to execute the stapling mode, the select switch SW1 is first pressed to designate the stapling mode, then, after the completion of a predetermined number of copying operation, the select switch SW1 is pressed again to execute the stapling operation.

SW2 is a stapling mode cancelling switch which cancels the stapling mode when pressed during the stapling mode with the ADF 30. For example, in case that the operation decides tomake ten sets of copying papers stapled and remain two other sets of copying papers unstapled, while copying ten sets of copying papers, the operator can press the cancelling switch SW2, during the processing of the eighth set of copying papers, to eject the papers of the ninth and tenth sets to the ejection try 80 without stapling.

Numeral 172 represents an indicator for indicating the number of stacked sets, that is, the number of stapled sets of copying papers. The numerical indication of the indicator 172 is incremented based on a signal from the controller on the copying machine 1, and the indicator 172 is reset based on a clear signal or the like form the controller.

(Control circuit)

Figure 13:
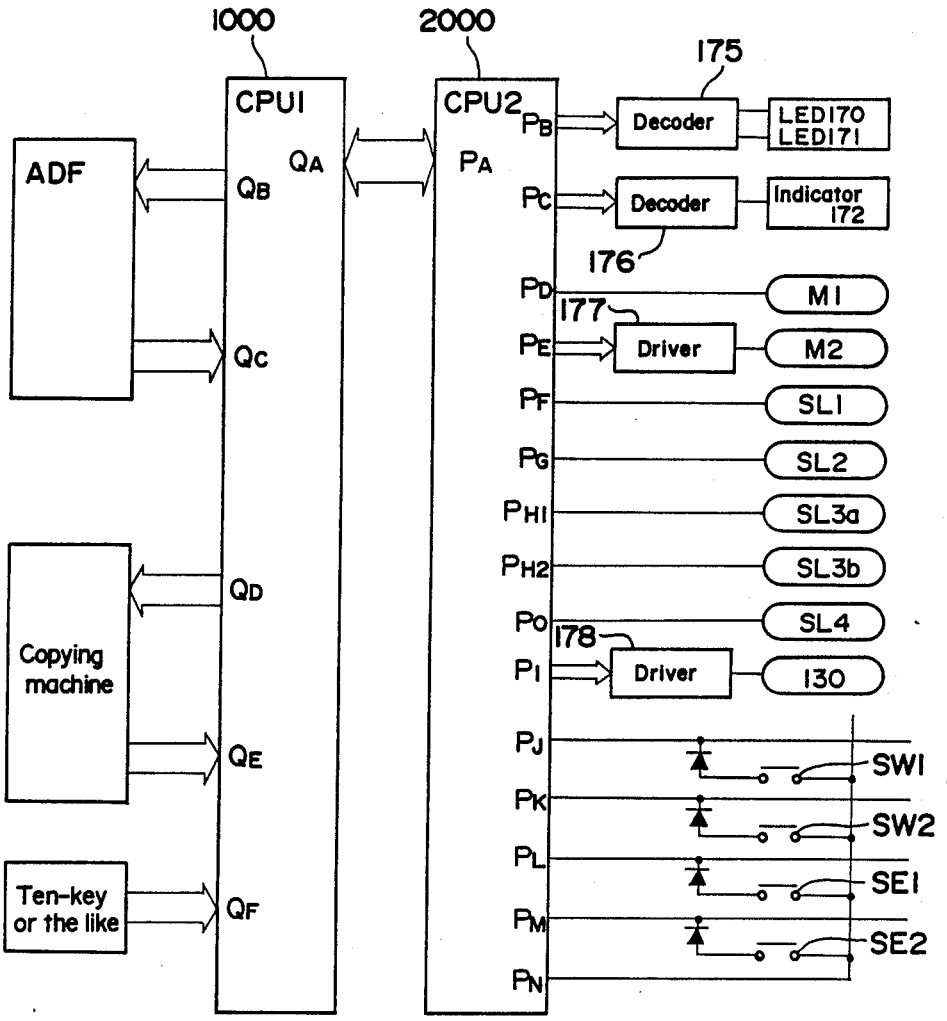

FIG. 13 illustrates a control cir5cuit on the copying apparatus. The first CPU 1000 controls the operations of the ADF 30 and copying machine 1. With the first CPU 1000, signals for controlling various movable elements on the ADF 30 are output from a port QB, and signals indicating the status of the ADF 30 are inputted to a port QC. Signals for controlling various movable elements on the copying machine 1 are output from a port QD and signals indicating the status of the copying machine 1 are inputted to a port QE. Into a port QF, numeric data or the like form the ten numeral keys 304 and each key on the control panel are inputted.

The second CPU 2000 controls the operation of the finisher unit 50. With the second CPU 2000, the indicator LEDs 170 and 171 are connected to a port PB via a decoder 175, and the indicator 172 for the number of stacked sets of copying papers is connected to a port PC via a decoder 176. The motor M1 for driving the rollers 60, 85 and 100 is connected to a port PD, and the motor M2 for driving the paddle wheel 120 is connected to a port PE via a driver 177. A port PF is connected to the solenoid SL1 for driving the diverting member 70; a port PG is connected to the solenoid SL2 for driving the stopper 95; ports PH1 and PH2 are connected to the solenoids SL3*a* and Sl3*b* for driving the pressing members 110*a* and 110*b*; and a port PO is connected to the solenoid SL4 for driving the paddle wheel unit. To a port PI, the stapler 130 is connected via a driver 178. Additionally, to ports PJ through PN, the switches SW1 and SW2, and the sensors SE2 and SE3 are correspondingly connected.

Further, the first CPU 1000 and second CPU 2000 exchange an ADF signal, a stapling signal, a copy signal, an ejection signal, a copy wait signal or the like via the ports QA and PA.

(Control procedure)

The control procedure of this embodiment is hereunder described in detail referring to FIG. 14 through FIG. 21.

In the following paragraphs, the term "on-edge" is defined as change in status, where the switch, sensor, signal or the like changes from the off status to the on status. In contrast, the term "off-edge" represents change in status, where the switch, sensor, signal or the like changes from the on status to the off status.

Figure 14:
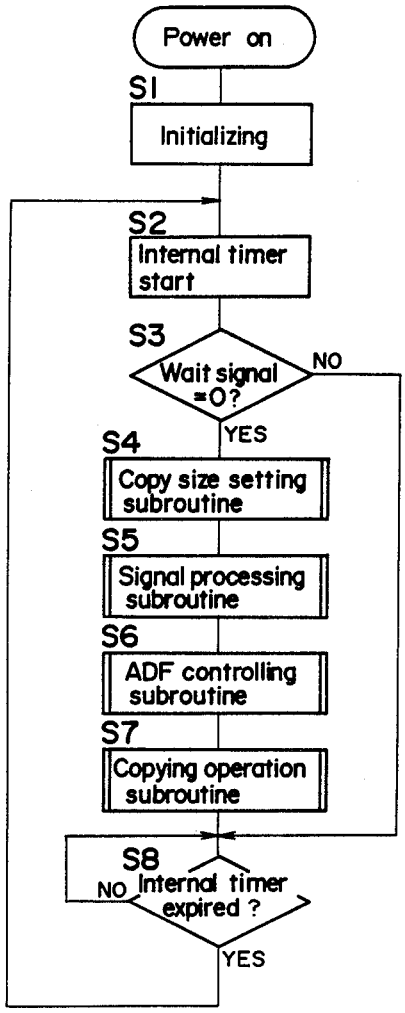

FIG. 14 is a flow chart schematically showing the processing operation carried out by the first CPU 1000.

When the power is turned on, the first CPU 1000 is reset, and the program is started, clears a RAM and various registers built in the first CPU 1000 and initializes various movable elements at step S1. Next, the internal timer is started at step S2. The internal timer decides a required duration of the routine of the first CPU 1000.

At step S3, the CPU 1000 judges the status of a wait signal transferred from the second CPU 2000. If the level of wait signal is at "1", the processing directly proceeds to step S8. If the level of wait signal is at "0", the processing runs the copy size setting subroutine at step S4, the signal processing subroutine at step S5, the ADF controlling subroutine at step S6, and the subroutine for controlling copying operation at step S7, further proceeds to step S8.

At step S8, the first CPU 1000 judges the completion of one cycle of the internal timer previously started at step S2. When it judges that one counting cycle of the internal timer has completed, the processing returns to step S2.

The copy size subroutine at step S4 and the signal processing subroutine at step S5 are hereunder described. Incidentally, the ADF controlling subroutine at step S6 and the copying operation subroutine at step S7 are similar as well known, the detailed description of them is omitted in this embodiment.

Figure 15A:
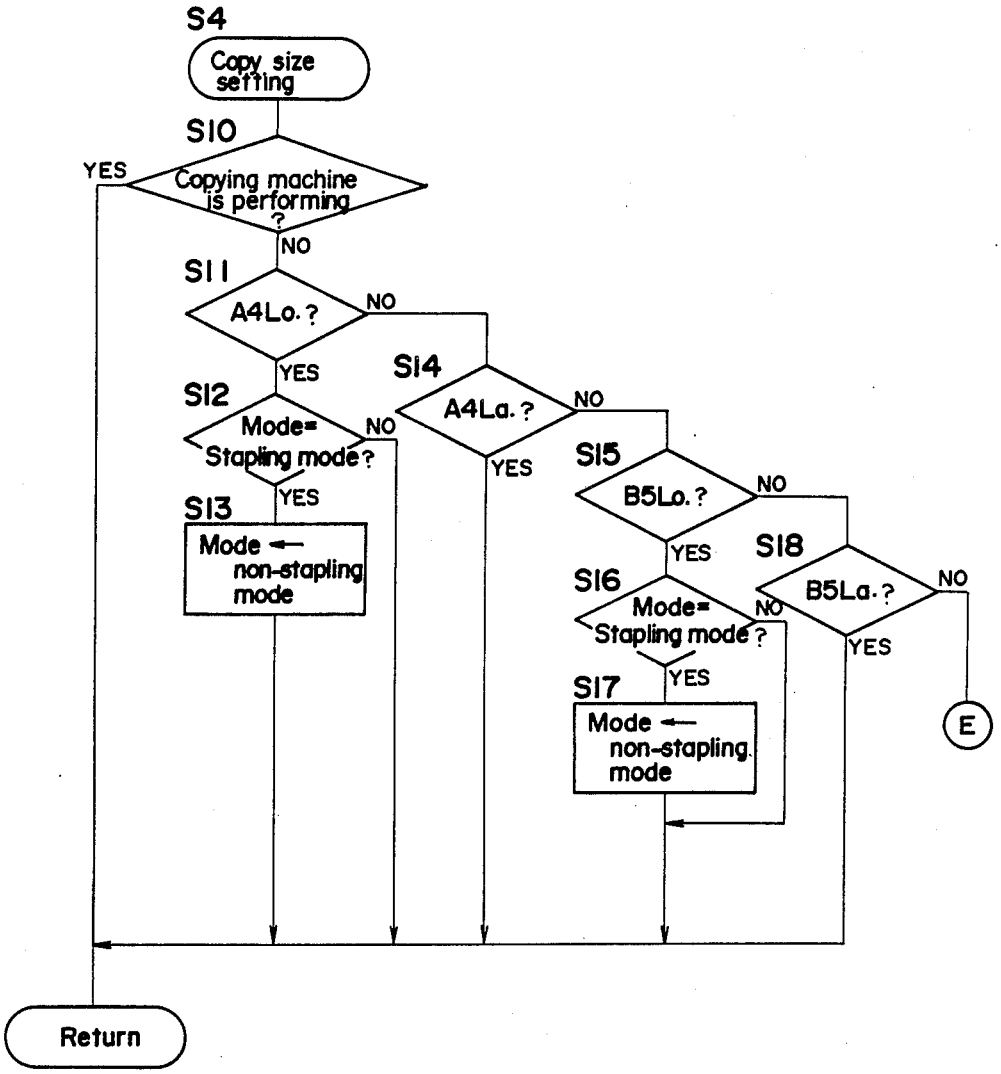
FIGS.15*a* and 15*b* are flow charts showing a subroutine for copy size setting.
Figure 15B:
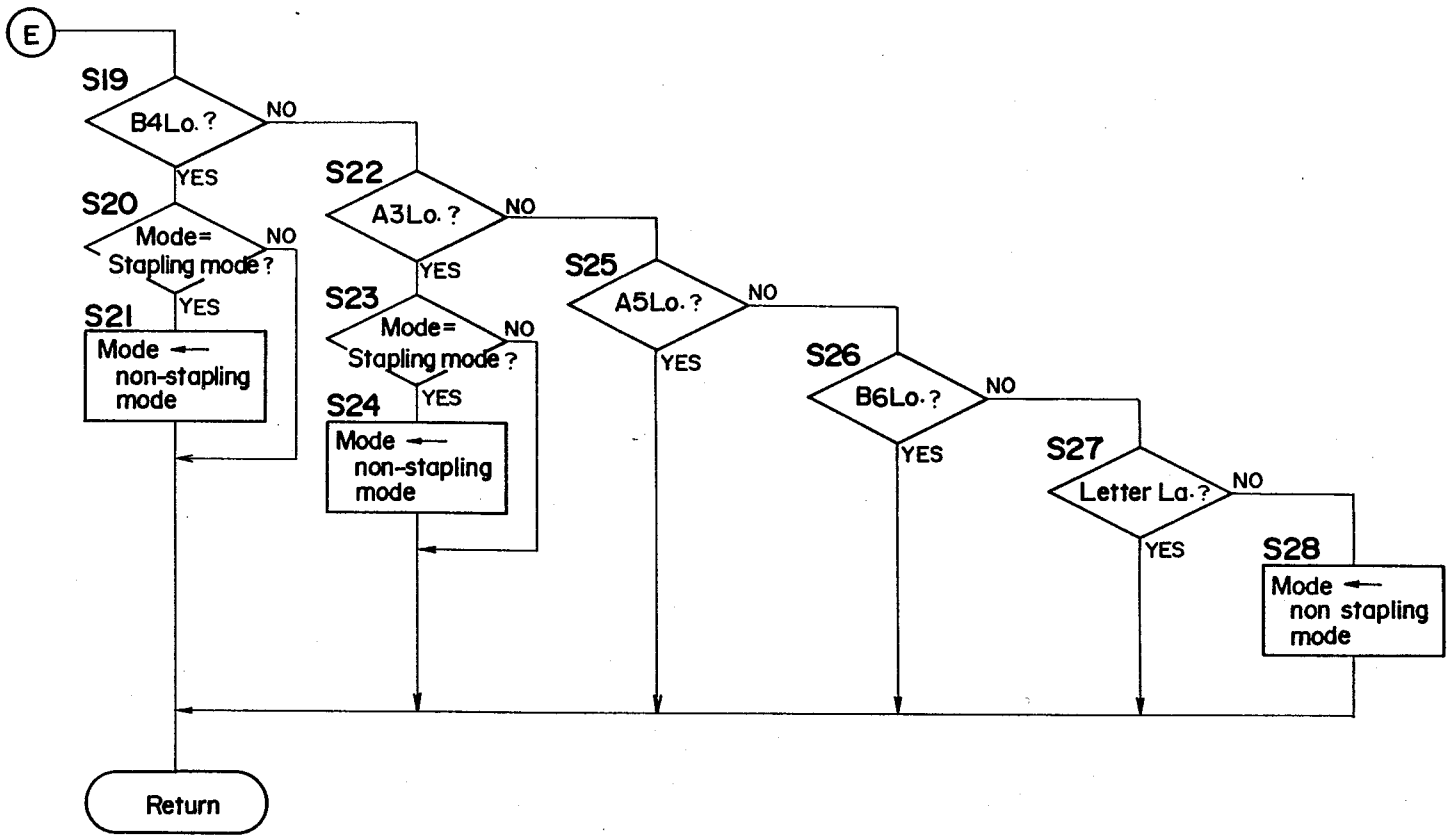

FIGS.15*a* and 15*b* are flow charts showing the copy size setting subroutine executed at step S4 of the main routine.

First, at step S10, whether or not the copying machine 1 is performing the copying operation is judged. If not, the processing goes to step S11, whether or not the paper of A4Lo. for copying is selected with the key 308 by an operator is judged. If the paper of A4Lo. has been selected, the processing goes to step S12, whether or not the operation mode of the finisher unit 50 is set to the stapling mode is judged. If the operation mode is currently set to the stapling mode, the operation mode is changed over to the non-stapling mode at step S13, this subroutine is terminated. In contrast, at said step S11, it is judged that the paper of A4Lo. has not been selected, the processing goes to step S14. at step S14, whether or not the paper of A4La. for copying is selected with the key 308 is judged. If the paper of A41a. has been selected, this subroutine is terminated. In the same way, at steP 818, it is judged that the paper of B5La. has been selected, this subroutine is terminated. In all cases of the selected paper except A4La., B5La., A5Lo., B6Lo. and letter La., at steps S15 through S17, S19 through S21, S22 through S24 and S28, the operation mode is set to the non-stapling mode according to the pattern of the processing at said steps S11 through S13 in which the paper of A4Lo. is selected.

In this embodiment, paper sizes available for stapling after the papers being received and aligned are limited to the paper of A4La., B5La., A5Lo., B6Lo. and letter La. Therefore, even if an operator selects the stapling mode for the finisher unit 50, the finishing mode is automatically changed over to the non-staple mode if the size of the paper for copying is other than aforesald sizes. The obtained mode for the finisher unit 50 is sent to the second CPU 2000 for processing therein.

Figure 16:
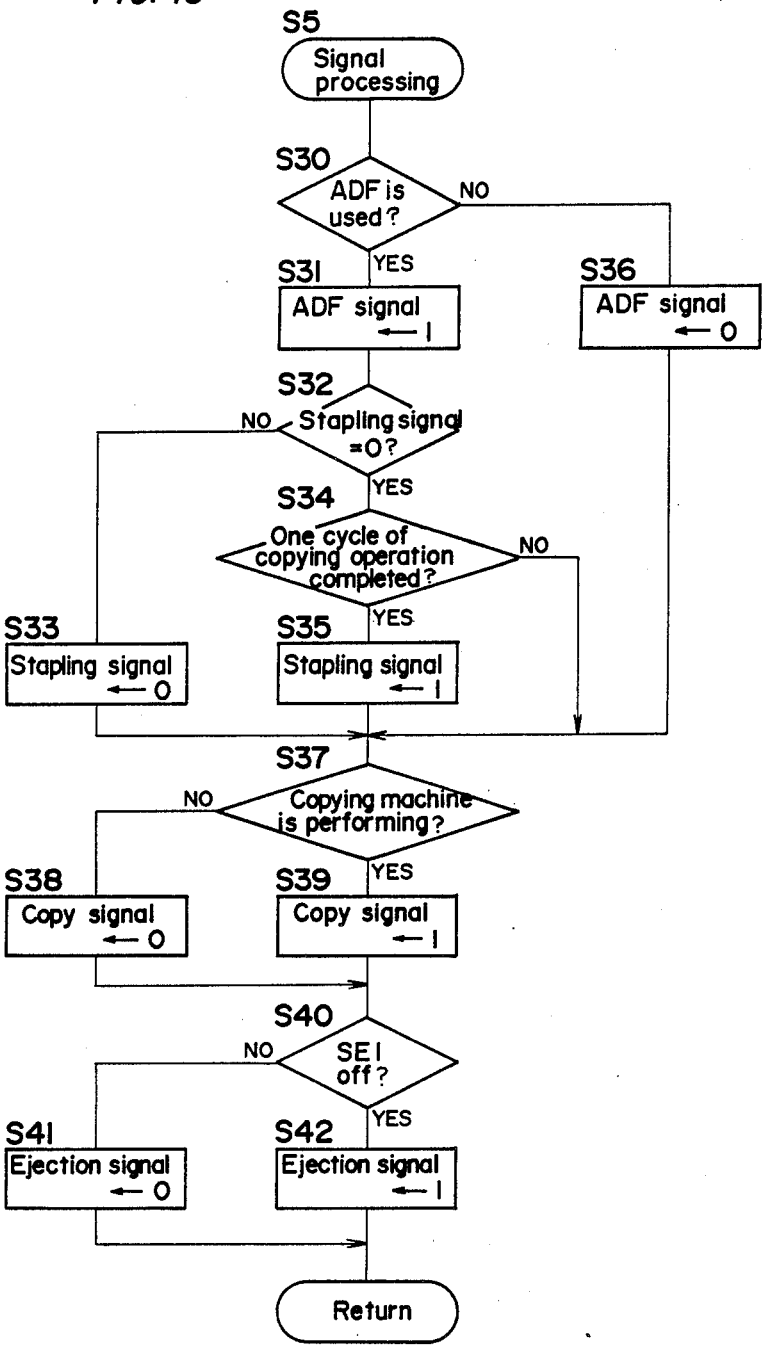

FIG.16 is a flow chart showing the signal processing subroutine executed at step S5 of the main routine.

First, whether or not the ADF 30 is currently used at step S30 is judged. If the ADF 30 is not used, an ADF signal is reset at the level of "0" at step 836, then the processing proceeds to step S37. If the ADF 30 is currently used, the ADF signal is set at the level of "1" at step S31 and whether or not a stapling signal is at the level of "0" at step S32 is judged. If the stapling signal has been set at the level of "1", the stapling signal is reset at the level of "0" at step S33 and the processing goes to step S37. If the stapling signal has been reset at the level of "0", whether or not one cycle of copying operation has completed at step S34 is judged. If one cycle of copying operation has not completed, the processing goes to step S37. If one cycle of copying operation has completed, the stapling signal is set at the level of "1" at step S35 and the processing goes to step S37.

At step S37, whether or not the copying machine 1 is performing the copying operation is judged. If the copying machine 1 is not performing the copying operation, the copy signal is reset at the level of "0" at step S38. If the copying machine 1 is performing the copying operation, the copy signal is set at the level of "1" at step S39. Next, at step S40, whether or not the sensor SE1 is in the off status is judged. If the sensor SE1 is in the on status, an ejection signal is reset at the level of "0" at step S41. In contrast, if the sensor SE1 is in the off status, the ejection signal is set at the level of "1" at step S42, thereby the subroutine is terminated.

Figure 17:
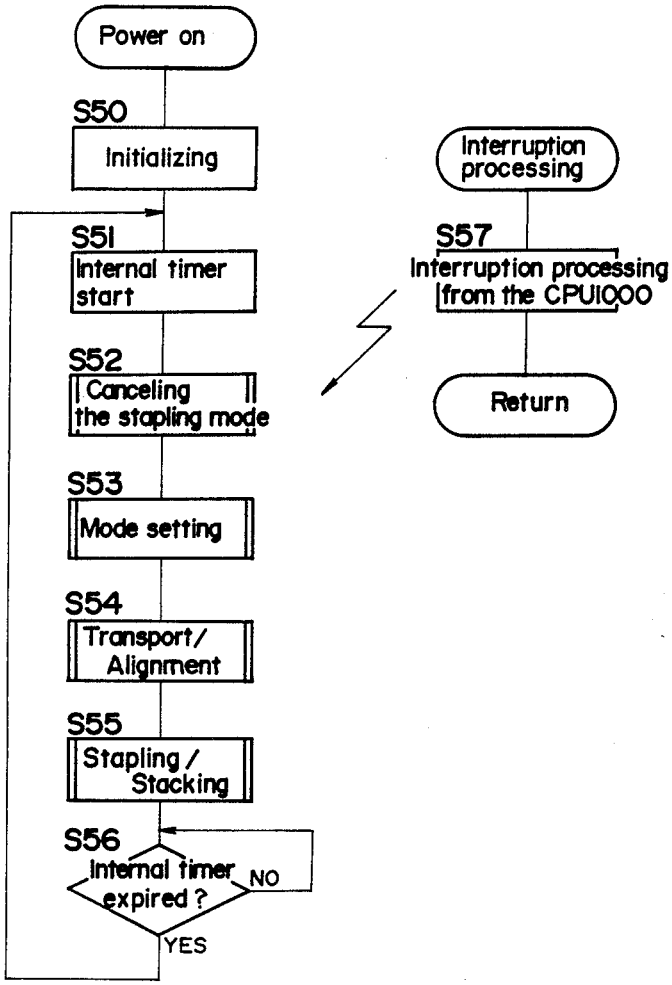

FIG.17 is a flow chart showing the main routine of the second CPU 2000.

Once the second CPU 2000 is reset to start the program at step S50, first clears a RAM and initializes various registers and each unit. Next, the internal timer is started at step S51. The internal tImer determIne a duratIon required for one cycle of the main routine.

Then, the subroutines at steps S52 through S55 are called. When all the subroutines have been terminated, the second CPU 2000 at step S56 waits for the completion of counting cycle of the internal timer and returns to step S51. With various tImes used in various subroutines, the count of each timer is performed based on the duration of one cycle of the main routine.

Additionally, upon the interruption request from the first CPU 1000 on the copying machine 1, the second CPU 2000 executes the interruption processing at step S57.

Figure 18:
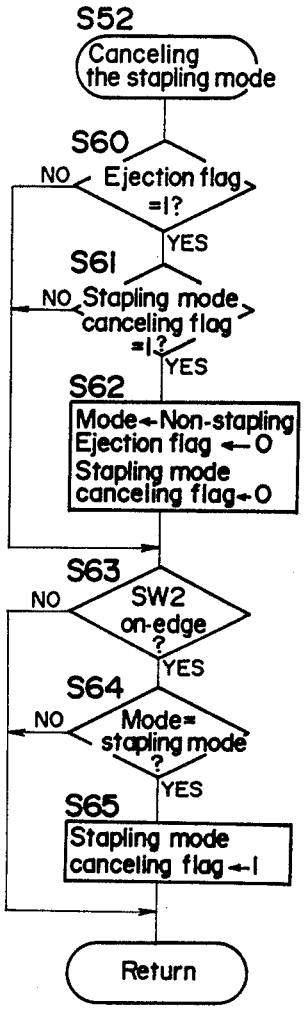

FIG.18 is a flow chart showing the subroutine at step S52 for cancelling the stapling mode.

First, whether or not an ejection flag is at the level of "1" at step S60 is judged, then whether or not a stapling mode cancelling flag is at the level of "1" at step S61 is judged. The ejection flag is set at the level of "1" when the stapled set of copying papers has been stored in the stack box 161, and is reset at "0" when the copying papers prepared in the next cycle of copying oPeration have been stored in the stapling tray 90. Additionally, the stapling mode cancelling flag is set at "1" when the cancelling switch SW2 is turned on. If both the ejection flag and the stapling mode cancelling flag are set at the level of "1", the non-stapling mode as a current operation mode at step S62 is designated, and the ejection flag is reset at "0" and the stapling mode cancelling flag is reset at "0".

Next, whether or not the stapling status of the cancelling switch SW2 is on-edge status at step S63 is judged. When the switch SW2 is changed over to on-edge, whether or not the stapling mode has been designated as a current operation mode at step S64 is judged. If the stapling mode has been designated, the stapling mode cancelling flag is set at the level of "1" at step S65. More specifically, the cancelling switch SW2 is arranged so as to accept cancelling instruction even during the copying operation, that is, so as to change the operation mode from the stapling mode to the non-stapling mode when the stapling mode cancelling flag is set at "1" and copying papers for current one cycle of copying operation are stapled then stored in the stack box 161 at steps S60 through S62.

Figure 19:
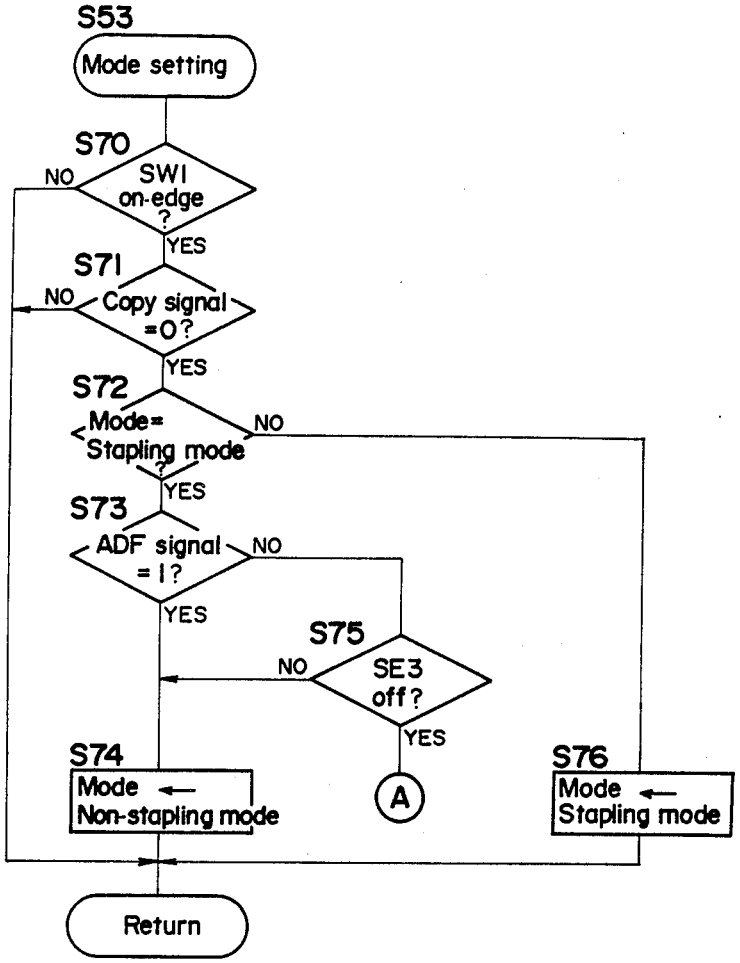

FIG.19 is a flow chart showing the mode setting subroutine executed at step S53 in the main routine.

In this subroutine, first, whether or not the signaling status of the mode select switch SW1 is on-edge status at step S70 is judged. When the similar status is changed over to on-edge, whether or not the copy signal has been reset at the level of "0" at step S71 is judged. The level of the copy signal is maintained a "1" when the copying machine 1 is performing the copying operation. Accordingly, it is judged that the level of the copy signal is at "0" and the copying machine 1 is not performing the copying operation, whether or not the stapling mode has been designated as the current operation mode at step S72 is judged. If the stapling mode has not been designated, the stapling mode is designated at step S76. If the stapling mode has been designated, whether or not the level of the ADF signal is at "1" at step S73 is judged, that is, whether or not the ADF 30 is currently used for the copying operation. If the ADF 30 is used, the non-stapling mode is designated at step S74. If the ADF 30 is not currently used, whether or not the sensor SE3 for detecting copying papers in the stapling tray 90 is in the off status at step 875 is judged. If the sensor SE3 has not been turned off, the non-stapling mode is similarly designated at step S74. If the sensor SE3 is put in the off status, the processing proceeds to step S523 of the transport/alignment subroutine shown in FIG.20*b*. More specifically, when the copying operation and the stapling operation are performed without using the ADF 30, the stapling operation is forcibly commenced by pressing the switch SW1, since a signal for automatically executing the stapling operation (stapling signal) is not generated. Additionally, when the sensor SE3 is in the off status, the stapling operation is performed, since there are copying papers present in the staple tray 90. However, when the sensor SE3 is in the on status, only the current operation mode is changed to the non-stapling mode, instead of executing the stapling operation, since there are no copying papers present in the stapling tray 90.

Figure 20A:
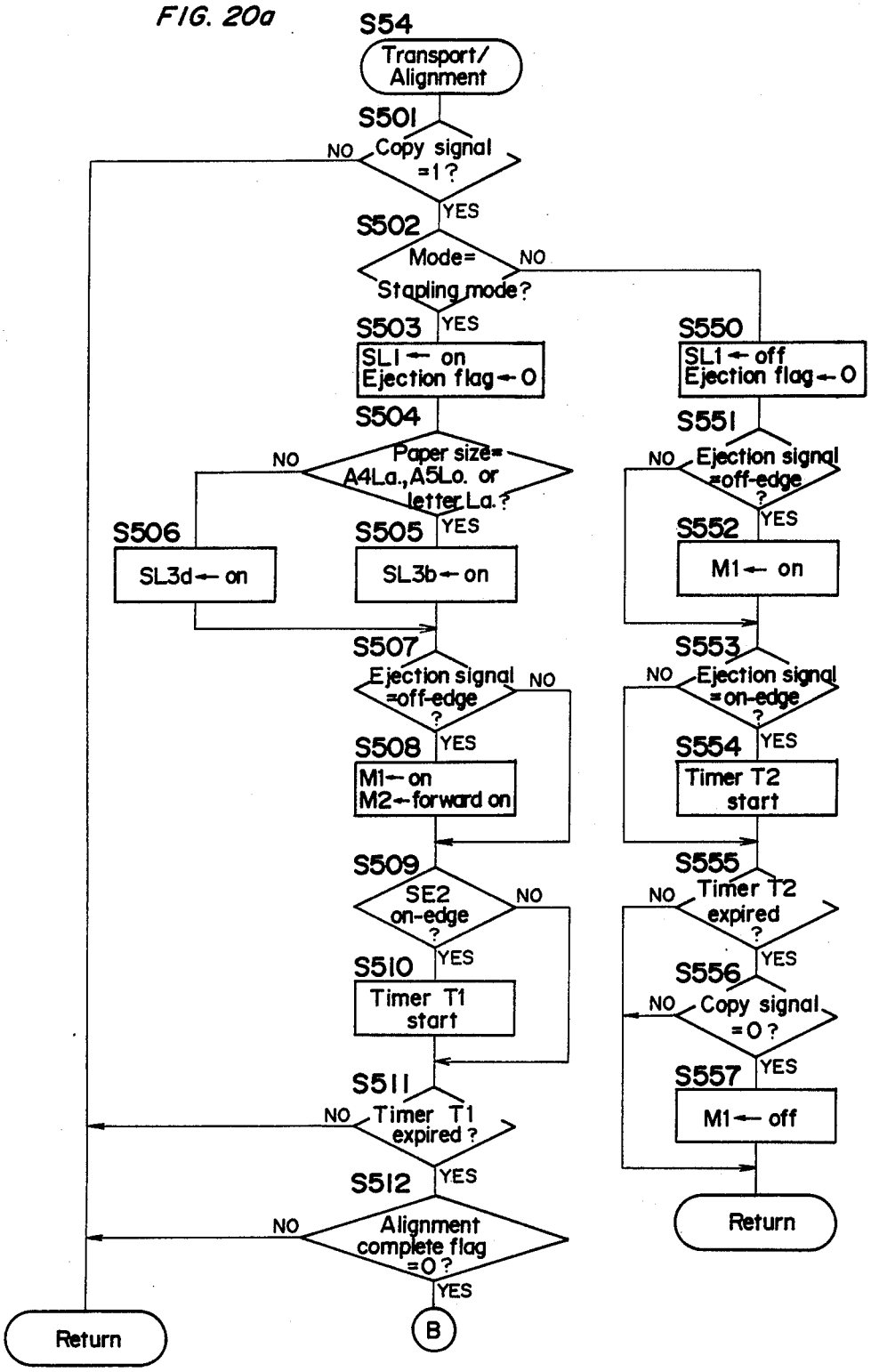
FIGS.20*a* and 20*b* are flow charts showing a subroutine for paper transport/alignment.
Figure 20B:
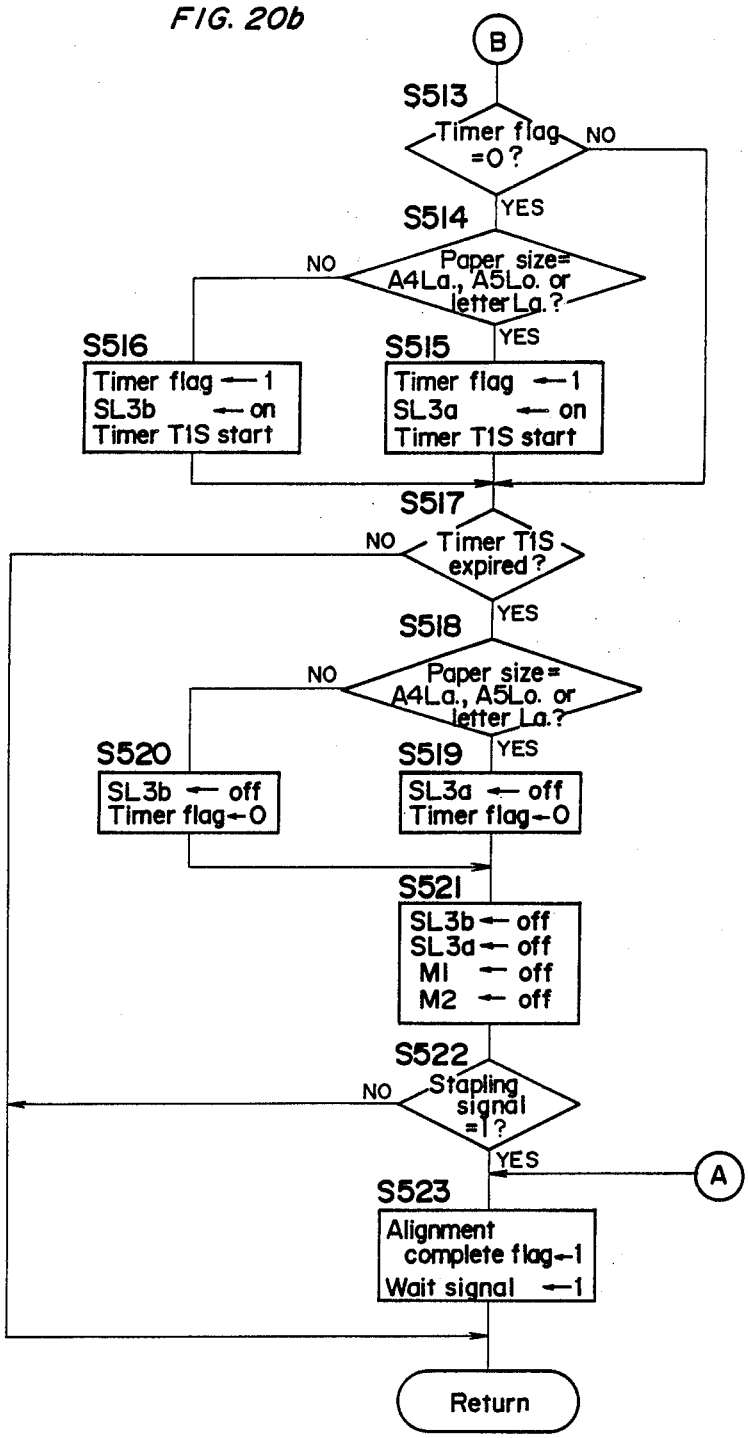

FIGS.20*a* and 20*b* are flow charts showing the transport/alignment subroutine performed at step S54.

First, whether or not the level of copy signal output from the first CPU 1000 has been at "1" at step S501 is judged, and whether or not the stapling mode has been designated as the current operation mode at step S502 is judged. If the above two criteria are satisfied, at step S503, the solenoid SL1 is turned on, when the diverting member 70 shifts to the position indicated by the solid line in FIG.1, and the ejection flag is reset at "0". Where the copy signal is at "1", it means that the copying operation is in progress, and where the copy signal is at "0", it means that the copying operation has been finished. The term "copying operation" means a process of operation beginning from a point of time at which the copy start key 301 is depressed and up to a point of time at which a cycle of copying operation is ended and copying papers are discharged into the tray 80 or stack box 161.

Next, at step S504, a judgment is made as to whether or not the paper size is A4La., A5Lo. or letter La. according to the paper size signal issued from the first CPU 1000. If the paper size is one or the other of the two, the lowerside positioned pressing members 110*b* are caused to retract from the base plate 91 by turning on the solenoid SL3b. If neither of them is applicable (in the case of B5La. or B6Lo.), the upperside positioned pressing members 110*a* are caused to retract from the base plate 91 by turning on the solenoid SL3a.

Then, at step S507, by means of the sensor SE1 disposed at a location in the transport path connecting the copying machine 1 and the finisher unit 50, a judgment is made as to whether or not the front end of paper in the course of transport has been detected, that is, whether the ejection signal obtained at said steps S40 to S42 for off-edge or not. If the ejection sIgnal is off-edge, at step S508, the drive motor M1 of the finisher unit 50 is switched on to rotate the rollers 60, 85 or the like, and the motor M2 for the paddle wheel 120 is driven in the direction of the arrow (c) in FIG.1.

At step S509, by means of the sensor SE2 disposed at a location in the transport path for guiding papers to the stapling tray 90 in the finisher unit 50, a judgment is made as to whether or not the front end of paper has been detected. If the result is "Yes", a timer T1 is started at step S510 for timing the retraction of the pressing member 110*a* or 110*b* (110*a* in the case of the paper size being A4La., A5Lo. and letter La. and 110*b* in the case of the paper size being B5La. and B6Lo.)

Next, at step S511, a judgment is made as to whether or not the front end of paper has been detected by the sensor SE2 and the time set by the timer T1 for paper arrival at the remaining pressing member 110*a* or 110*b* has been passed. At step S512, a judgment is made as to whether or not the ADF 30 is in use and an alignment complete flag is at "0", which is to be set to "1" when all papers obtained in one cycle of copying operation are stored in the stapling tray 90. If it is judged that the timer TI has completed its course and the alignment complete flag is at "0", the processing proceeds to step S513 as shown in FIG.20*b*.

At step S513, a judgment is made as to whether or not the timer flag is at "0", which is to be set at "1" simultaneously when the solenoid SL3*a* or SL3*b* is switched on at step S515 or S516, and if the timer flag is at "0", the processing proceeds to step S514. At step S514, if a paper size signal sent from the first CPU 1000 is A4La., A5Lo. or letter La., the upperside positioned pressing members 110*a* are caused to retract from the windows 93*a* in the guide plate 93 by turning on the solenoid SL3*a*, at step S515. At the same time, a timer T1S is set for the time of up to the stopper 95 being reached by the front end of each paper to be received in position after the solenoid SL3*a* is switched on, and the timer flag is set to "1". If, at said step S514, neither of the paper sizes is applicable, the lowerside positioned pressing members 110*b* are caused to retract from the windows 93*b*, in the guide plate 93 by turning on the solenoid SL3*b*, at step S516. At the same time, the time for arrival of the front end of each paper to be received after the solenoid SL3*b* being turned on is set by the timer T1S, and the timer flag is set to "1". The timer flag is intended to prevent the solenoid (SL3*a* in case of the paper size being A4La., A5Lo. and letter La. and SL3*b* in case of the size being B5La. and B6Lo.) from being turned on twice for setting of the timer T1S. That is, where the timer flag is at "1", it means that the solenoid SL3*a* has been turned on and the timer T1S has been set, in case of the paper size being A4La., A5Lo. and letter La. Accordingly, in case of the paper size being B5La. and B6Lo, the solenoid SL3*b* has been turned on and the timer T1S has been set.

At step S517, a judgment is made as to whether or not the timer T1S set at said step S516 or S515 has completed it course. If the result is "Yes", at step S518, a judgment is made as to whether or not the paper size signals sent from the first CPU 1000 are A4La., A5Lo. or letter La., if the result is "Yes", the upperside positioned pressing members 110*a* are caused to press the upper portion of the papers received into the stapling tray 90 by turning off the solenoid SL3*a*, whereas if it is "No" at said steP S518, the lowerside positioned pressing members 110*b* are caused to press the upper portion of the papers received into the stapling tray 90 by turning off the solenoid SL3*b*.

Next, at step S521, the pressing members 110*a* and 110*b* are respectively caused to move through the windows 93*a* and 93*b* in the guide plate 93 by turning off the solenoid SL3*a* and SL3*b*, the motor M1 on the finisher unit 50 and the motor M2 for rotation of the paddle wheel 120 are caused to stop running. Then, the processing proceeds to step S522. At this step S522, a judgment is made as to whether or not the stapling signal is at "1" , and if the result is "Yes", the alignment complete flag and the wait signal are both set to "1". When the alignment complete flag is set to "1" , the processing proceeds to next subroutine, step 855 and it is now possible to perform stapling operation.

On the other hand, the result is "No" at said step S502, when the non-stapling mode is executed, first, at step 8550, the solenoid SL1 is turned off and the diverting member 70 maintains in the position indicated by the dashed line in FIG. 1. At this time, the ejection flag is reset at "0". Then, once the status of the ejection signal has been off-edge is confirmed at step S551, the motor M1 is turned on in order to drive the rollers 60 and 85 or the like at step S552.

Next, once the status of the ejection signal has been on-edge is confirmed at step S553, a timer T2 is started at step S554. The duration at which end a copying paper is completely ejected is incorporated into the timer T2. When the counting cycle of the timer T2 is confirmed at step S555, and at next step S556 when the level of the copy signal is at "0" is confirmed, the motor Ml is turned off at step S557 and the processing is terminated this subroutine.

Figure 21:
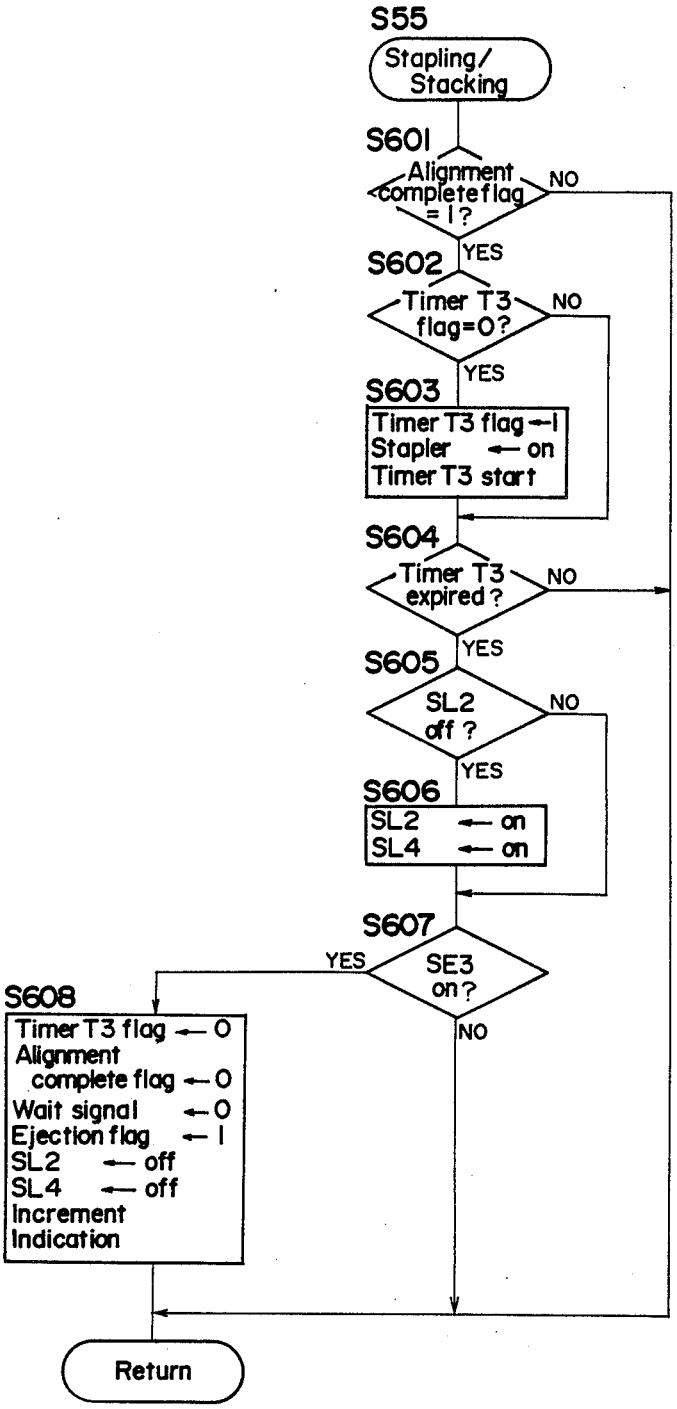

FIG.21 is a flow chart showing the stapling/stacking subroutine executed at step S55 in the main routine.

First, at step S601, whether or not the level of the alignment complete flag is set at "1" is judged. Then, at step S602, whether or not the level of the timer T3 flag is reset at "0" is judged. If both the criterial are satisfied, which means the completion of alignment of copying papers stored in the stapling tray 90, at step S603, the level of the timer T3 flag is set at "1" and the stapler 130 is turned on in order to staple the copying papers. Additionally, the stapler start signal is turned off instantaneously. At the same time, the timer T3 is started. The timer T3 serves to synchronize the timing to open up the stopper 95. At step S604, once the completion of counting cycle of the timer T3 is confirmed, at step S605, whether or not the solenoid SL2 has been turned off is judged if the solenoid SL2 is at the off status, at step S606, the solenoid SL2 is turned on to open up the stopper 95, which allows the stapled copying papers to fail freely. At the same time, the solenoid SL4 is turned on to relieve the contact between the paddle wheel 120 and the stapled papers.

Next, at step 8607, whether or not the sensor SE3 which detects the copying papers stored in the stapling tray 90 is in the on status is judged. If the sensor SE3 is in the on status, which means that one set of the copying papers ejected from the stapling tray 90 has been detected, at step S608 the timer T3 flag, the alignment complete flag and the wait signal are reset respectively at the level of "0", and the ejection flag is set at the level of "1", and simultaneously, the solenoids SL2 and SL4 are turned off, then the second CPU 2000 increments the number of stacked set of the display 172, and indicates the number with the display 172.

[Second Embodiment]

Figure 22:
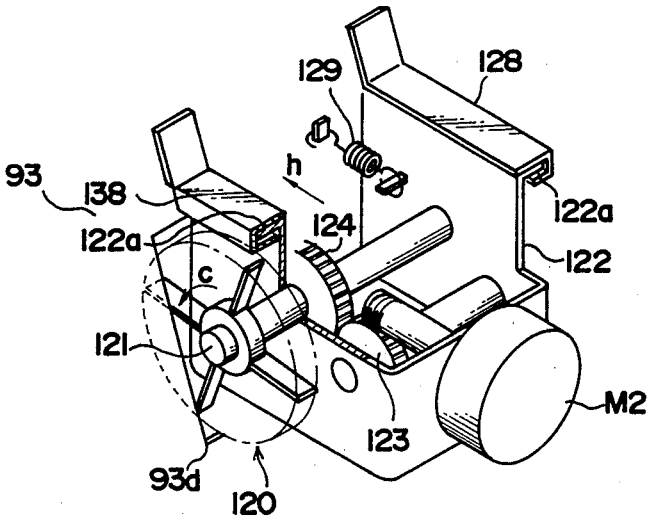
FIG.22 is a perspective view of a driving mechanism for a paddle wheel in a second embodiment.

The second embodiment, as shown in FIG.22, is the same as the above-mentioned first embodiment in that the paddle wheel 120 itself is retracted outwardly when stapled papers are discharged from the stapling tray 90, its contact with the papers being thus removed, but slide motion is adopted for retraction of the paddle wheel 120.

That is, the bracket 122 is slidably mounted on rail members 128 and 128 fIxed to the guide plate 93 through lugs 122*a* and 122*a* which are formed on both sides of the bracket 122. The bracket 122 is constantly urged by a tension coil spring 129 toward the base plate 91 (see FIG.1) as indicated by the arrow (h) and removable by a solenoid not shown in a direction opposite to the direction of the arrow (h). Additionally, the paddle wheel 120 fixed to the axle 121 is arranged freely rotatable on the bracket 122 through the axle 121 and actuated In the dIrectIon of the arrow (c) by the motor M2.

Therefore, when the solenoid is in off condition, the paddle wheel 120 is urged by the biasing force of the tension coil spring 129 in the direction of the arrow (h) so that it can plunge into the stapling tray 90 through the long hole 93*d* of the guide plate 93 for contact with coPying papers as they are transported, to thereby exert the transporting force on them. simultaneously upon the action of the stopper 95 being relieved after stapling, or immediately prior to that time, the solenoid is turned on so that the entire unit of the paddle wheel 120 is caused to slide outward. Thus, the contact of the paddle wheel 120 with the stapled papers is removed.

In other respects, the arrangement of the second embodiment is the same as that of the first embodiment. Drawings and description in these respects are therefore omitted.

This second embodiment is the same as the first embodiment in that the contact pressure of the paddle wheel 120 can be maintained constant by the action of the tension coil spring 129 irrespective of the number of copying papers received in position.

[Third Embodiment]

In the third embodiment, the base plate which constitutes the stapling tray is adapted to be retracted outward, whereby the contact of the paddle wheel relative to the copying papers can be removed.

Figure 23:
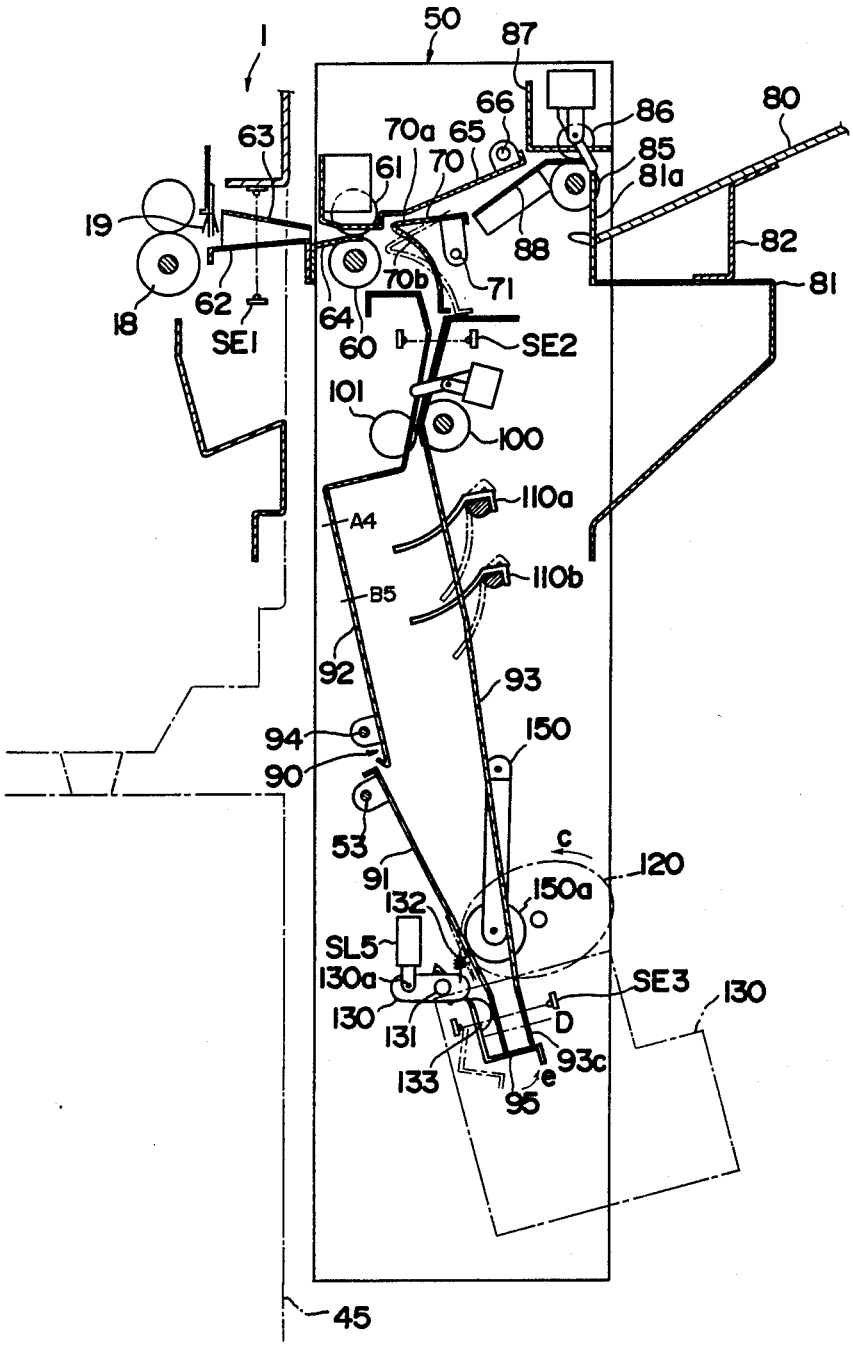
FIG.23 is an internal composition showing a finisher unit of a third embodiment.
Figure 24:
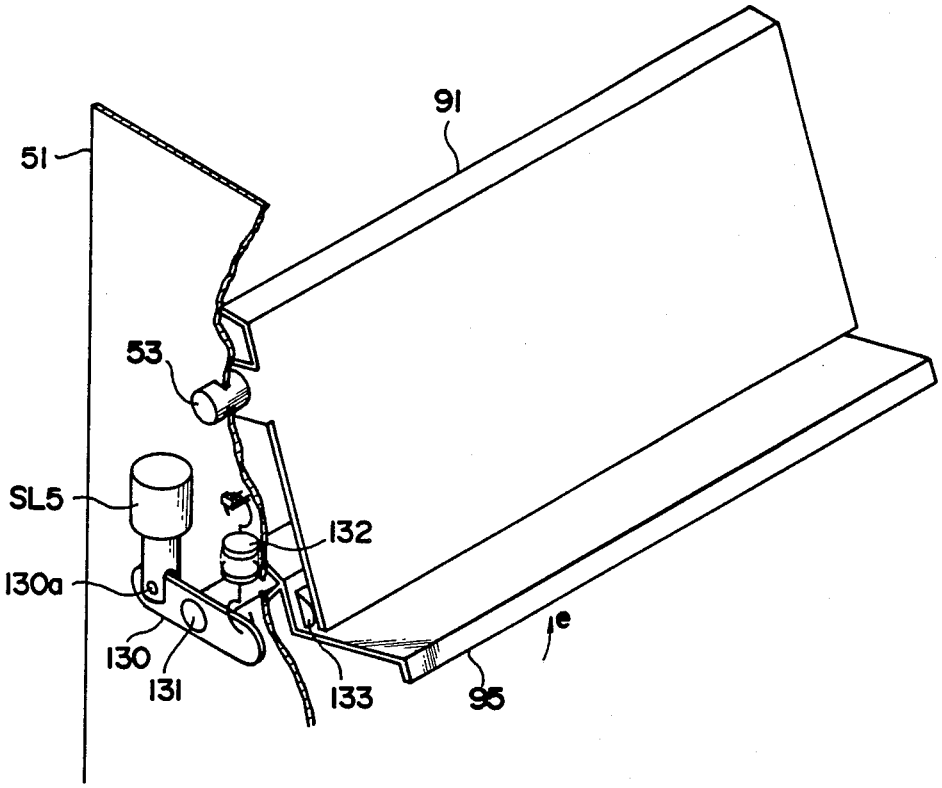
FIG.24 is a perspective view showing a stapling tray and an actuating mechanism for the tray shown in FIG.23.

That is, shown in FIGS.23 and 24, the base plate 91 is pivotable about a support shaft 53 provided at the top end thereof and is held in position by its lower rear surface being in abutment with a ledge 133 mounted to the stopper 95 under the weight of the base plate 91. The stopper 95 is rotatably attached to a shaft 131 through an arm 130 which is connected with a solenoid SL5 via a pin 130*a*. Both the stopper 95 and the arm 130 are urged in the direction of an arrow (e) by a coil spring 132. Therefore, when the stopper 95 is at its position for closing the bottom of the stapling tray 90, the base plate 91 is set to a paper accommodatIon and alignment position shown by the solid line in FIG.23. When the solenoid SL5 is turned on, the stopper 95 removes in the reverse direction of the arrow (e) and releases the bottom of the stapling tray 90, and the base plate 91 is pivotally moved accordingly to a position shown by the dashed line in FIG.23 to widen the lower end space of the stapling tray 90. Thus, the contact between stapled papers and the paddle wheel 120 is relieved so that the stapled papers are smoothly discharged.

In other respects, the arrangement of the third embodiment is the same as that of the above-mentioned first embodiment. Drawings description in these respects are therefore omitted.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A paper handling apparatus for storing papers ejected from an image forming apparatus, aligning and stapling them by stapling means, comprising:

a tray for storing the ejected papers therein in substantially vertical position which has an alignment reference member in its lower portion;

means for transporting the ejected papers into said tray from above;

a plurality of pressing means each of which corresponds to a respective size of paper for pressing a surface of each paper transported into said tray at an upper portion thereof against said tray;

control means for actuating one of said pressing means corresponding to the size of the transported paper in conjunction with the operation of said transport means;

means for aligning each paper being transported into said tray along said alignment reference member; and means for stapling the aligned papers.

2. A paper handling apparatus for storing papers ejected from an image forming apparatus, comprising:

a tray having a substantially vertical surface for storing the ejected papers thereon and provided with a regulating member at a lower portion thereof for regulating the end of each paper;

means for transporting the ejected papers into said tray from above;

a plurality of pressing means each of which corresponds to a respective size of paper for pressing a surface of each paper transported into said tray at an upper portion thereof against said tray; and control means for actuating one of said pressing means corresponding to the size of the transported paper in conjunction with the operation of said transport means.

3. A paper handling apparatus for storing papers ejected from an image forming apparatus, comprising:

a tray for storing the ejected papers therein which has an alignment reference number at one end for aligning each paper at the front end thereof;

means for transporting the ejected papers into said tray from another end thereof toward said alignment reference member;

a plurality of pressing means each of which corresponds to a respective size of paper for pressing the surface of each paper transported into said tray at a portion thereof against said tray; and control means for actuating one of said pressing means corresponding to the size of the transported paper in conjunction with the operation of said transport means.

4. A paper handling apparatus wherein papers ejected from an image forming apparatus are sequentially transported into a tray having a front and alignment reference line, aligned at a corner portion of the tray, and stapled by stapling means, said apparatus comprising:

a tray for storing and aligning the ejected papers therein in a substantially vertical position;

means for transporting the ejected papers into said tray; and aligning means arranged at a distance from said transport means such that the aligning means can act on the paper while the transport means acts on the paper and for applying a transporting force to the paper so that when the trailing end of the paper being transported into said tray leaves said transport means, an angle defined by the direction of the force given to the paper and the front end alignment reference line is smaller than an angle defined by a straight line connecting the corner of the paper closest to said corner portion and said alignment corner portion and said front end alignment reference line.

5. A paper handling apparatus as set forth in claim 4, wherein said tray is substantially vertically positioned and wherein the component of the transporting speed of said aligning means in the transport of the paper toward said front end alignment reference line is faster than the transporting speed of said transport means and the paper transporting force of said aligning means is smaller than that of said transport means.

6. A paper handling apparatus for storing papers ejected from an image forming apparatus, aligning them and stapling them by stapling means, comprising:

a tray having a substantially vertical surface for storing the ejected papers thereon and provided with a regulating member at the lower portion for regulating the end of each paper;

means for transporting the ejected papers down into said tray;

a plurality of pressing means each of which corresponds to various sizes of papers for pressing a surface of each paper transported into said tray at an upper portion thereof against said tray;

control means for actuating one of said pressing means corresponding to the size of transported papers in conjunction with the operation of said transporting means;

aligning means for putting the ejected paper into a specified position, said aligning means having a contacting member which contacts the surface of each paper being transported into said tray to urge the paper to the specified position;

means for stapling the papers aligned by said aligning means;

means for discharging the stapled papers from said tray; and means for releasing the papers from the pressure of said contacting member by moving said tray away from said contacting member when said discharging means is actuated in operation.

7. A paper handling apparatus wherein papers ejected from an image forming apparatus are sequentially transported into a tray having a front end alignment reference line, aligned at a corner of the tray and stapled by stapling means, said apparatus comprising:

a tray having a substantially vertical surface for storing the ejected papers thereon and provided with a regulating member at a lower portion for regulating the end of each paper;

means for transporting the ejected papers down into said tray;

a plurality of pressing means each of which corresponds to a respective size of paper for pressing a surface of each paper transported into said tray at an upper portion thereof against said tray;

control means for actuating one of said pressing means corresponding to the size of the transported papers in conjunction with the operation of said transporting means;

aligning means arranged at a distance from said transporting means that is shorter than the length of any paper to be transported into said tray, said aligning means providing a transporting force to a paper at a smaller angle to the front end alignment reference line than an angle defined by a straight line from the corner of the paper to the alignment corner when the paper is discharged from said transporting means and the front end alignment reference line; and means for stapling the papers aligned by said aligning means.

8. A paper handling apparatus wherein papers ejected from an image forming apparatus are sequentially transported into a tray having a front end alignment reference line, aligned at a corner and stapled by stapling means, said apparatus comprising:

a tray for storing and aligning the ejected papers therein, said tray being substantially vertically positioned;

means for transporting the ejected papers into said tray; and aligning means which is so arranged that the distance between said transporting means and said aligning means is shorter than the length of any paper to be transported into said tray, said aligning means providing a transporting force to a paper at a smaller angle to the front end alignment reference line than an angle defined by a straight line from the corner of the paper to the alignment corner when the paper is discharged from said transporting means and the front end alignment reference line, wherein the component of the speed of the aligning means transporting the paper toward said front end alignment reference line is faster than the transporting speed of said transporting means and the paper transporting force of said aligning means is smaller than that of said transporting means.

* * * * *